US007824278B2

(12) United States Patent
Miyamichi

(10) Patent No.: US 7,824,278 B2
(45) Date of Patent: Nov. 2, 2010

(54) PUTTER FACE AND GOLF PUTTER HAVING PUTTER FACE INSERTED THEREIN

(75) Inventor: Saburo Miyamichi, Osaka (JP)

(73) Assignee: M-System Co., Ltd., Osaka-Shi (JP)

( * ) Notice: Subject to any disclaimer, the term of this patent is extended or adjusted under 35 U.S.C. 154(b) by 6 days.

(21) Appl. No.: 12/288,325

(22) Filed: Oct. 17, 2008

(65) Prior Publication Data

US 2009/0131197 A1 May 21, 2009

(30) Foreign Application Priority Data

Oct. 19, 2007 (JP) ..... 2007-272309
Feb. 29, 2008 (JP) ..... 2008-051230

(51) Int. Cl.
*A63B 53/04* (2006.01)

(52) U.S. Cl. ..... 473/329; 473/340; 473/342

(58) Field of Classification Search ..... 473/324–350
See application file for complete search history.

(56) References Cited

U.S. PATENT DOCUMENTS 922,444 A * 5/1909 Youds ..... 473/342
1,449,559 A * 3/1923 So Relle ..... 473/342
1,485,685 A * 3/1924 McMahon ..... 473/342
1,494,494 A * 5/1924 Lippincott ..... 473/342
1,595,589 A * 8/1926 Tyler ..... 473/332
1,646,461 A * 10/1927 So Relle ..... 473/342
1,654,257 A * 12/1927 Hillerich ..... 473/342
1,659,272 A * 2/1928 Link ..... 473/342
1,699,874 A * 1/1929 Buhrke ..... 473/342
1,704,119 A * 3/1929 Buhrke ..... 473/342

(Continued)

FOREIGN PATENT DOCUMENTS

JP 09173510 A * 7/1997

(Continued)

OTHER PUBLICATIONS

Notice of Reasons for Refusal dated Jul. 29, 2008 in corresponding Japanese Patent Application No. JP2008-051230.

*Primary Examiner*—Alvin A Hunter
(74) *Attorney, Agent, or Firm*—Edwards Angell Palmer & Dodge LLP; David G. Conlin; David A. Tucker

(57) ABSTRACT

In order to solve a problem of a shift of a rebounding direction due to a contact of a golf ball and a ball contact surface of a putter face, while attaining an initial velocity, a striking touch, and a sense of distance, each of which are compared favorably to a metal face, a putter face is arranged including hexagonal posts (4) each made of material having a higher rigidity than a ball (7), the hexagonal posts (4) having a contact surface (41) which has contact with the ball (7), and impact-absorbing rings (5) made of material having a lower rigidity than that of the hexagonal posts (4), so as to elastically support the hexagonal posts (4) in a normal direction of the contact surfaces (41), wherein the plurality of hexagonal posts (4) are juxtaposed in an in-plane direction of the contact surfaces (41) and the contact surfaces (41) constitute a single surface when the ball (7) is not in contact with the contact surfaces (41).

2 Claims, 15 Drawing Sheets

U.S. PATENT DOCUMENTS

| | | | | | |
|---|---|---|---|---|---|
| 1,704,165 | A | * | 3/1929 | Buhrke | 473/342 |
| 1,840,451 | A | * | 1/1932 | Jansky | 473/330 |
| 3,847,399 | A | * | 11/1974 | Raymont | 473/350 |
| 4,679,792 | A | * | 7/1987 | Straza et al. | 473/329 |
| 4,681,322 | A | * | 7/1987 | Straza et al. | 473/329 |
| 5,060,951 | A | * | 10/1991 | Allen | 473/346 |
| 5,083,778 | A | * | 1/1992 | Douglass | 473/329 |
| 5,301,941 | A | * | 4/1994 | Allen | 473/327 |
| 5,497,993 | A | * | 3/1996 | Shan | 473/329 |
| 5,620,382 | A | * | 4/1997 | Cho et al. | 473/331 |
| 5,807,190 | A | * | 9/1998 | Krumme et al. | 473/342 |
| 5,967,903 | A | * | 10/1999 | Cheng | 473/342 |
| 6,007,435 | A | * | 12/1999 | Chern | 473/342 |
| 6,089,993 | A | * | 7/2000 | Woodward et al. | 473/331 |
| 6,261,192 | B1 | * | 7/2001 | Otani | 473/324 |
| 6,270,423 | B1 | * | 8/2001 | Webb | 473/226 |
| 6,277,033 | B1 | * | 8/2001 | Krumme et al. | 473/342 |
| 6,431,997 | B1 | * | 8/2002 | Rohrer | 473/324 |
| 6,699,140 | B1 | * | 3/2004 | Sun | 473/252 |
| 6,932,716 | B2 | * | 8/2005 | Ehlers et al. | 473/329 |
| 7,192,365 | B2 | * | 3/2007 | Souza et al. | 473/329 |
| 7,273,420 | B2 | * | 9/2007 | Wright | 473/329 |
| 7,309,296 | B2 | * | 12/2007 | Souza et al. | 473/329 |
| 2005/0009623 | A1 | * | 1/2005 | Dickinson | 473/329 |
| 2007/0178987 | A1 | | 8/2007 | Wright | |

FOREIGN PATENT DOCUMENTS

| | | | |
|---|---|---|---|
| JP | 2001-000603 | | 1/2001 |
| JP | 2001-224716 | | 8/2001 |
| JP | 2001-293116 | | 10/2001 |
| JP | 2001293116 | A * | 10/2001 |

* cited by examiner

CROSS SECTIONAL VIEW A-A

CROSS SECTIONAL VIEW A-A

CROSS SECTIONAL VIEW A-A

PUTTER FACE AND GOLF PUTTER HAVING PUTTER FACE INSERTED THEREIN

This Nonprovisional application claims priority under U.S.C. §119(a) on Patent Application No. 272309/2007 filed in Japan on Oct. 19, 2007, and Patent Application No. 051230/2008 filed in Japan on Feb. 29, 2008, the entire contents of which are hereby incorporated by reference.

FIELD OF THE INVENTION

The present invention is related to a putter face inserted to a golf putter head, and a golf putter having the golf putter head in which the putter face is inserted.

BACKGROUND OF THE INVENTION

A golf ball generally has an infinite number of dimples. In a case of a golf putter having a putter head face (hereinafter may be referred to as "putter face") made of metal or a composite that is sufficiently high in rigidity as compared to a rigidity of the golf ball and its surface, a ball contact surface of the putter face (hereinafter may be referred to as "face surface") and the golf ball has point contact, particularly in a short putt or a descending line.

Note that the rigidity is generally represented by modulus of elasticity (Young's modulus), shear modulus of elasticity, and the like. In a point of comparison in physical property values, the higher the rigidity the more difficult for a shape to change, and the lower the rigidity the softer the material.

As described above, when the face surface and the golf ball has point contact, particularly when an edge part of the dimples on the golf ball has point contact with the face surface, the golf ball rolls in a trajectory off a target direction perpendicular to the face surface, due to a shift of a rebounding direction caused by the edge part of the dimple. For example, in theory, a problem occurs such that a disposition of 16 mm to 22 mm occurs 1.2 m away from the face surface.

In order to solve such a problem, there have been reference techniques in which a depressed section is formed on one part of the face surface of the putter head, so as to insert a face made of material having a low rigidity, such as resin material. This allows the ball contact surface of the face to change its shape along a spherical surface of the golf ball.

One example of such reference technique is a golf putter 100 disclosed in Japanese Unexamined Patent Publication No. 224716/2001 (Tokukai 2001-224716; published on Aug. 21, 2001).

In FIG. 15, (a) is a front view of a golf putter 100 from a face surface side, and (b) is a side view of the golf putter 100 having the face surface side as front.

The golf putter 100 is arranged so that a head 102 is attached to a tip section of a shaft 101, as illustrated in (a) and (b) of FIG. 15.

In addition, a depressed section is formed on a part of a face surface 103 of the head 102, and a face plate 104 is assembled on this depressed section.

Further, the face plate 104 is made of resin material which has a surface hardness of a JIS (Japanese Industrial Standard)-D in a range of 40 to 60, a resilience in a range of 30% to 60%, and a coefficient of kinetic friction on a surface in a range of 0.4 to 2.0. Such the face plate 104 thus allows the golf putter 100 to attain a soft touch, a good sense of distance, and good control performance at the time when striking a ball.

The surface hardness of the JIS-D less than 40 causes the face plate 104 to be excessively soft, and the surface hardness of the JIS-D more than 60 makes it impossible to attain the soft touch at the time when striking the ball.

The resilience not within the range of 30% to 60% causes difficulty in attaining an aimed distance.

Furthermore, the coefficient of kinetic friction less than 0.4 causes a direction of the ball thus struck to be unstable, due to a quick separation of the ball from the face plate 104.

Other than the above, a U.S. patent (U.S. Pat. No. 6,699,140B1; patented on Mar. 2, 2004) discloses a putter face composed of three layers of soft polymer.

In addition, a U.S. patent (U.S. Pat. No. 4,679,792; patented on Jul. 14, 1987) discloses a putter face having a plurality of independent cells of an elastic body made of epoxy resin, which plurality of independent cells construct a honeycomb structure.

The golf putter 100 is inserted with the face plate 104 whose ball contact surface is made of soft material (resin), therefore the face elastically deforms along a spherical surface of the ball. This prevents occurrence of effects caused by the edge part of the dimples. However, loss of energy at a time of impact is great as compared to a hard metal face.

Therefore, no matter how the material of the face is prepared, the golf putter 100 drops in an initial velocity as compared to the hard metal face. As a result, a problem occurs such that a sufficient touch at a time when striking the ball (hereinafter referred to as "striking touch") and a sufficient sense of distance (rolling of the ball in accordance with the touch) are not attained.

It is believed that a sense of sound of an impact sound that is produced when the ball and the putter face collide with each other subtly influences this striking touch. Therefore, it is assumed that for intermediate and advanced players of golf, this subtle difference in the sense of sound influences their playing performance.

That is to say, it is expected that although a beginner of golf would preferably use the golf putter 100 attainable of a good sense of distance and good control performance while having a soft touch, the intermediate and advanced players of golf may feel unsatisfied with the golf putter 100 due to this subtle difference in the sense of sound.

Namely, it is considered that for the intermediate and advanced players of golf, the impact sound which is produced in collision of the ball and a putter face having a higher rigidity than the ball (for example, a putter face made of metal) is an important factor which influences their playing performance.

The putter face described in the U.S. patent (U.S. Pat. No. 6,699,140B1; patented on Mar. 2, 2004) consists of three layers of soft polymer. This putter face simply piles three layers of elastic bodies. Although this putter face elastically deforms so as to prevent the effects caused by the edge part of the dimples, it is believed that the loss of energy at the time of the impact is still high, as compared to the hard metal face.

Further, the putter face described in the U.S. patent (U.S. Pat. No. 4,679,792; patented on Jul. 14, 1987) has a plurality of independent cells which construct a honeycomb structure. Each of the cells is an elastic body made of epoxy resin, therefore has a strong frictional force between the cells. As a result, the plurality of cells is elastically deformed in connection with each other. Consequently, although the putter face is constructed of the plurality of independent cells, functions of the putter face are hardly different to the putter face having an elastic body inserted therein as disclosed in the Japanese Unexamined patent publication No. 224716/2001 (Tokukai 2001-224716; published on Aug. 21, 2001) and the U.S. patent (U.S. Pat. No. 6,699,140B1; patented on Mar. 2, 2004). Therefore, although the effect caused by the edge part of the dimple is prevented, the loss of energy at the time of the impact is high, as compared to the hard metal face.

SUMMARY OF THE INVENTION

An object of the present invention is to provide a putter face that can attain an initial velocity, a striking touch, and a sense of distance of a ball, each of which compares favorably with a metal face, while solving a problem of an occurrence of a shift of a rebounding direction caused by a golf ball and a ball contact surface of the putter face having contact with each other.

In order to attain the object, a putter face of the present invention is a putter face to be inserted to a golf putter head, the putter face including: a plurality of pillar-shaped bodies, each made of material having a higher rigidity than a ball, and each having a contact surface that has contact with the ball; and a plurality of elastic bodies, each being attached to respective one of the pillar-shaped bodies so as to elastically support the respective one of the pillar-shaped bodies in a normal direction of the contact surfaces, and each made of material having a lower rigidity than that of the respective one of the pillar-shaped bodies, the plurality of pillar-shaped bodies being juxtaposed in an in-plane direction of the contact surfaces, and the contact surfaces of the plurality of pillar-shaped bodies constituting a single surface when a ball is not in contact with the contact surfaces.

According to the arrangement, a putter face of the present invention includes a plurality of pillar-shaped bodies, each made of material having a higher rigidity than a ball, and each having a contact surface that has contact with the ball; and an elastic body made of material having a lower rigidity than that of the pillar-shaped bodies, so as to elastically support the respective one of the pillar-shaped bodies in a normal direction of the contact surface.

The arrangement is one which a contact surface that has direct contact with a ball has high rigidity (is unreadily deformed), and impact of a collision on the contact surface is indirectly absorbed by an elastic deformation of an elastic body. Therefore, loss in coefficient of restitution is minimized as compared to a soft resin face (readily deformed). Namely, since the loss in coefficient of restitution is small as compared to a face made of soft material such as resin, it is possible to attain, at a time of striking (impact), an initial velocity that compares favorably with a metal face.

Moreover, kinetic energy of the ball is proportional to a square of the initial velocity. Therefore, loss in energy at the time of the impact is also reduced. As a result, it is possible to attain a touch of striking (hereinafter referred to as simply "striking touch") and a sense of distance (rolling in accordance with the touch), each of which are compared favorably with the metal face.

At the time of the impact, the contact surface of the pillar-shaped bodies made of the material having the higher rigidity than the ball collides with the ball. This thus attains an impact sound which is produced at a time when a putter face having a rigidity higher than the ball (for example, a putter face made of metal) collides with the ball. Therefore, it is possible to attain a sense based on sound (hereinafter referred to as "sense of sound") that compares favorably with the metal face. Thus, it is possible to attain a sufficient initial velocity, sense of sound and striking touch, each of which is not attainable from a resin face.

According to the arrangement, the putter face of the present invention is arranged such that the putter face includes a plurality of the elastic bodies, each being attached to respective one of the pillar-shaped bodies.

This thus enhances independency of elastic motion of each of the pillar-shaped bodies.

Adoption of the arrangement allows arrangement of the putter face of the present invention such that when the ball has contact with the respective contact surfaces of the plurality of pillar-shaped bodies, the plurality of elastic bodies are elastically deformed in the normal direction so that the respective contact surfaces have contact with a plurality of places on a surface of a ball (the face surface deforms so that the respective contact surfaces are alongside the surface of the ball).

Until there is contact with the ball, the plurality of pillar-shaped bodies are juxtaposed in an in-plane direction of the contact surfaces so that the contact surfaces of the pillar-shaped bodies constitute a single surface when the ball is not in contact with the contact surfaces.

That is to say, assume a case where a ball collides on a face surface in a perpendicular direction with respect to the face surface, in an initial condition that the contact surfaces of the pillar-shaped bodies constitute a single surface when a ball is not in contact with the contact surfaces. Note that, from motion relativity, this alternatively can be considered as having the ball collide on the face surface of a still golf putter instead of striking a still ball by use of the golf putter. In such a case, it is expected that the contact surfaces isotropically deform in shape about its center which is a contact point of the ball and the face surface (assumedly substantially matching an intersection of a central axis of the ball in a normal direction of the face surface and the face surface), due to spherical symmetry of the ball. Note that this isotropic deformation of the contact surfaces would still be attained even if deformation of the ball occurs.

In view of this, it is expected that all of repulsion vectors (reaction vectors) which have effect on a contact section on the contact surfaces of the ball are accurately directed to a vicinity of a predetermined point on a central axis of the ball in a normal direction of the face surface. In addition, a resultant vector of these is accurately directed to a direction along the central axis, that is, the normal direction of the face surface. The ball receives force in a direction along the resultant vector, therefore the ball accurately rolls in the direction along the resultant vector, that is, the normal direction of the face surface.

Strictly speaking, in a collision phenomenon, it is necessary to solve an equation of motion in which a difference in momentum vector before and after colliding to a ball is equal to an integral of an impulse vector of which the ball has received, and complex simultaneous equations such as a relational expression between a coefficient of restitution of the face surface and a change in velocity before and after colliding to the ball. However, qualitatively, the direction of the resultant vector is considered such that during the collision, the direction of the resultant vector is hardly shifted from the direction along the central axis. Therefore, it is expected that the above conclusion be attained.

Therefore, as described above, the contact surfaces of the plurality of pillar-shaped bodies have contact with the ball in a plurality of places on the surface of the ball so that the contact surfaces are alongside the surface of the ball. Therefore, the occurrence of the shift of a rebounding direction of the ball caused by the point contact with the dimple edge parts on the surface of the ball is prevented.

A phenomenon called face rotation often is raised as a problem. This face rotation is a phenomenon such that, even if a ball is impacted provided that a moving direction of the putter head visually matches with a normal direction of the face surface of the putter face (or the contact surfaces of the plurality of pillar-shaped bodies), a progressing direction of the ball slides off from the moving direction of the putter head (aimed direction) due to the arrangement of the golf putter.

This phenomenon is caused by having two elliptic trajectories: (1) a striking trajectory of the putter head (an elliptic trajectory in a substantially perpendicular direction with respect to the putter head); and (2) a rotational trajectory of the putter head in line with a user's body (an elliptic trajectory in a substantially horizontal direction with respect to a face surface seen from above), be combined into one complex trajectory, as a trajectory of the face surface of the golf putter. As a result, the face surface has contact with the ball in a direction that is shifted off from a direction perpendicular to the face surface (aimed direction) at the time of the impact, even though the normal direction of the face surface and the moving direction of the putter head visually match with each other.

Moreover, at the time of the impact on the ball, a motion to return the face is often carried out by naturally synchronizing with a wrist movement. However, in such a case, the face surface rotates about an axis which runs substantially along a shaft of the golf putter. When this rotating movement is further added to the two elliptic movements, the face rotation becomes more intense.

In comparison, in the putter face of the present invention, the face (the contact surfaces of the plurality of pillar-shaped bodies) deforms at the moment of impact so as to have a longer contact time between the ball and the face as compared to the golf putter having the metal face, even if the face surface has contact with the ball in an angle shifting off a perpendicular direction with respect to the ball caused by the face rotation movement.

Reaction received from the face surface of the golf putter during the contact time is further divided into (i) normal force in a perpendicular direction of the face surface and (ii) friction in the in-plane direction of the face surface. In theory, this friction has a component which causes the ball to correct its progressing direction so as to follow a moving direction (aimed direction) of the putter head (impede the ball from shifting off sideways with respect to the face surface) as a result of elastic deformation of the face surface.

Here, a putter head made of metal is regarded as a rigid body whose face surface does not deform. Therefore, the contact time of the ball and the face is short, and is considered that hardly any friction occurs with the putter head made of metal.

On the other hand, in the putter face of the present invention, each of the plurality of pillar-shaped bodies is elastically deformable. Therefore, at the time of the impact, the face surface deforms so as to be alongside the surface of the ball, thereby having contact with a plurality of places on the ball. Therefore, as described above, along with a long contact time between the ball and the face, it is expected that sufficient friction occurs on the ball as compared to the putter head made of metal.

Accordingly, caused by this friction, a striking direction of the ball is corrected so as to be closer to the aimed direction than that of a hard metal putter face. Therefore, it is possible to accurately strike the ball in the moving direction (aimed direction) while compensating a slight angle slide of the face.

In other words, it is assumed that since a component of friction that corrects a shift of a striking direction of the ball from the moving direction of the putter head (aimed direction) is sufficiently provided with respect to an impulse given to the ball, it is possible to prevent the shift of the striking direction of the ball from the aimed direction.

It is believed that intermediate and advanced golf players are capable of using various types of shots for different purposes. Particularly in putting, it is considered that subtle ball control is required. For example, there are many examples in which strengths and weaknesses (for example, a hook ball in which a ball hit by a right (left) player swerves to the left (right), and a slice ball which is the opposite of that) influence a result of a game.

As described above, the putter face of the present invention is arranged such that when the ball has contact with the respective contact surfaces of the plurality of pillar-shaped bodies, the plurality of elastic bodies are elastically deformed in the normal direction of the face surface (contact surface) so that the respective contact surfaces have contact with a plurality of places on a surface of a ball.

Therefore, in the putter face of the present invention, the face (the contact surfaces of the plurality of pillar-shaped bodies) deforms at the moment of impact so as to have a longer contact time between the ball and the face as compared to the golf putter having the metal face.

Moreover, as described above, the reaction received by the ball from the face surface of the golf putter during the contact time is divided into (i) the normal force in a perpendicular direction of the face surface and (ii) the friction in the in-plane direction of the face surface. This friction is considered to be fairly great as compared to the golf putter having the hard metal face which is difficult to elastically deform (as a result, having a short contact time between the ball and the face).

Accordingly, the golf putter of the present invention is sufficiently effected by the friction as compared to the golf putter having the metal face. This thus allows, as compared to the golf putter having the metal face, improvement of ball control performance such as using various types of shots for different purposes for example the hook ball, and the slice ball opposite of the hook ball, improve propulsion to the aim by applying topspin to the ball (also referred as "positive rotation"; hereinafter referred as similar), and further apply backspin to the ball (negative rotation) so that the ball stops on the green.

Moreover, effects thus operating synergistically enables attainment of (i) an initial velocity, an intermediate velocity, and an attained distance of the ball, each of which are compared favorably to that of a hard metal putter face, with respect to a motion velocity (impact energy) of the putter head, and (ii) sufficient linearity (proportionality) with respect to the putter head having these physical quantities.

As described above, it is possible to provide a putter face that can attain an initial velocity, a striking touch, and a sense of distance of a ball, each of which compares favorably with a metal face, while solving a problem of an occurrence of a shift of a rebounding direction caused by a golf ball and a ball contact surface of the putter face having contact with each other.

Additional objects, features, and strengths of the present invention will be made clear by the description below. Further, the advantages of the present invention will be evident from the following explanation in reference to the drawings.

DESCRIPTION OF THE EMBODIMENTS

One embodiment of the present invention is described below, with reference to FIGS. 1 through 14.

First Embodiment

The following description explains an arrangement of one embodiment of a head part, which head part is a main section of a golf putter in the present embodiment, with reference to FIGS. 1 through 7. The following description explains the head part of the golf putter, and explanations of arrangements of other parts of the golf putter in the present embodiment are omitted, since these parts are to be arranged as similar to a regular golf putter. In addition, arrangements and material of elements in the golf putter except for putter faces 2A and 2B are not particularly limited.

Figure 1:
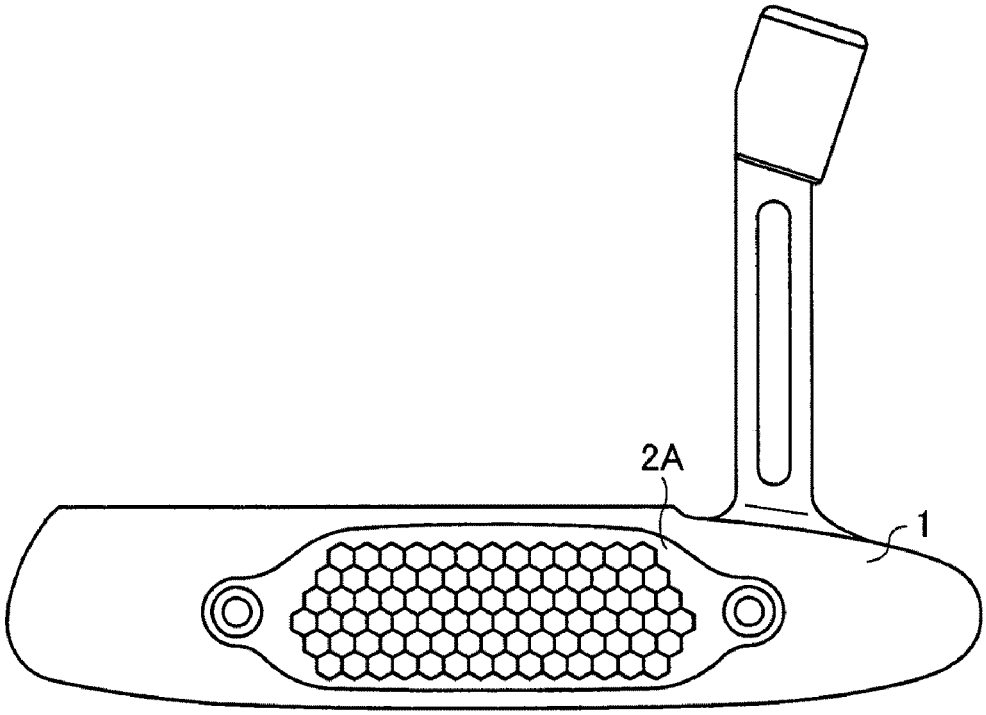
FIG. 1 is a diagram schematically illustrating one embodiment of a head part of a golf putter in the present invention.

FIG. 1 is a diagram schematically illustrating an arrangement of a head part of a golf putter in the present embodiment, which head part is a main section of the golf putter.

As illustrated in FIG. 1, the head part which is a main section of the golf putter in the present embodiment includes a putter head 1 and a putter face 2A (or, a putter face 2B later explained). That is to say, the golf putter as one embodiment of the present invention is a golf putter in which the putter face 2A or the putter face 2B is inserted to the putter head (head) 1.

As illustrated in FIG. 1, the putter face 2A of the present embodiment adopts an arrangement which provides two screw holes for a setscrew (not illustrated), in order to screw the putter face 2A on the putter head 1. Such an arrangement minimizes a screw hole part for fixing the putter face 2A to the putter head (head) 1. Therefore, it is possible to reduce surplus areas of a face surface side of the putter face 2A.

In the present embodiment, the putter head 1 and the putter face 2A (or the putter head 2B) are joined by use of screws and screw holes, however an attachment method of the putter face 2A to the putter head 1 of the golf putter is not particularly limited. For example, the putter face 2A can be attached to the putter head 1 by methods such as adhesion, welding, fitting caused by frictional force, and mechanical joining by use of screws and the like. Moreover, an arrangement in which the putter face 2A (or putter face 2B) is inserted to the putter head 1 in a detachable state allows a user to change the putter faces of various features as appropriate while playing a game. Therefore, it is possible to change a feature of a putter face in accordance with a striking touch and a sense of distance. Note that the putter face 2A (or the putter face 2B) may be colored in an arbitrary color.

Figure 2:
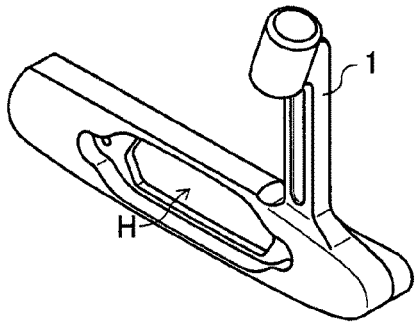
FIG. 2 is a diagram schematically illustrating an arrangement of a putter head in which a putter face is not yet inserted, wherein (a) illustrates a diagonal view of the arrangement of the putter head in which the putter face is not yet inserted, (b) illustrates a front view of the putter head from a face surface side, (c) illustrates an upper view of the putter head having the face surface side of the putter head as front, (d) illustrates a right side view thereof, and (e) illustrates a cross sectional view taken on a line A-A as illustrated in (b).
Figure 2:
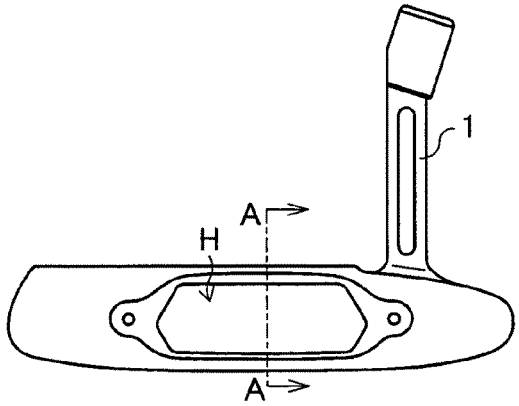
Figure 2:
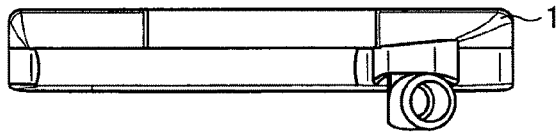
Figure 2:
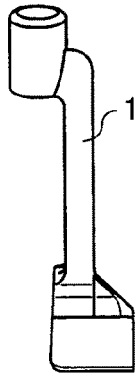
Figure 2:
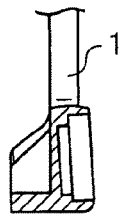

The following description explains in detail of an arrangement of the putter faces 2A and 2B, which are to be inserted to the putter head 1 and putter head 1, respectively, with reference to FIGS. 2 though 7.

In FIG. 2, (a) illustrates a diagonal view of the arrangement of the putter head 1 in which the putter face 2A is not yet inserted, (b) illustrates a front view of the putter head 1 from a face surface side, (c) illustrates an upper view thereof, (d) illustrates a right side view thereof, and (e) illustrates a cross sectional view taken on a line A-A as illustrated in (b) of FIG. 2.

As illustrated in (a) and (b) of FIG. 2, an opening H so as to insert the putter face 2A (the same applies for the putter face 2B later explained) is provided on a face surface side of the putter head 1. The opening H thus illustrated in (a) and (b) of FIG. 2 are formed so as to fit a shape of the putter face 2A, however for the putter face 2B and the like later explained, a shape of the opening H may be formed so as to fit the shape of each of the putter faces as appropriate.

Figure 3:
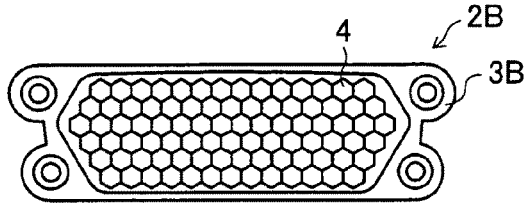
FIG. 3 is a diagram schematically illustrating an arrangement of the putter face and each of its constitutional elements, wherein (a) illustrates an upper view of the arrangement of the putter face, (b) illustrates a side view of the arrangement of the putter face, (c) illustrates an upper view of the arrangement of the putter face, (d) illustrates a hexagonal post, an impact-absorbing ring, and a pedestal in a disassembled form, each of which construct the putter face, and (e) illustrates the hexagonal post, the impact-absorbing ring, and the pedestal illustrated in (d) in an assembled form.
Figure 3:
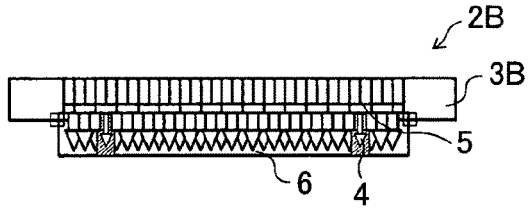
Figure 3:
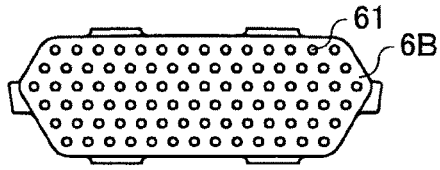
Figure 3:
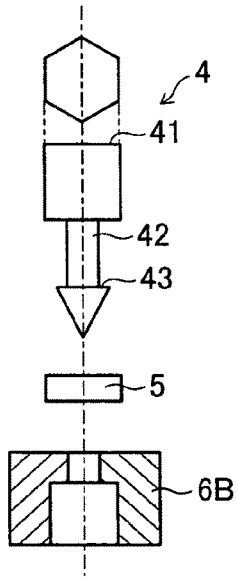
Figure 3:
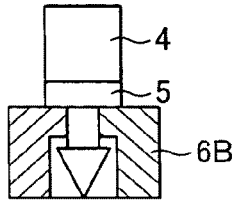

In FIG. 3, (a) illustrates an upper view of the arrangement of the putter face 2B, (b) illustrates a side view of the arrangement of the putter face 2B, (c) illustrates an upper view of an arrangement of a pedestal 6B of the putter face 2B, (d) illustrates a hexagonal post (pillar-shaped body, putter face) 4, an impact-absorbing ring (elastic body, putter face) 5, and a pedestal (putter face) 6B (note that, hereinafter, a pedestal corresponding to the putter face 2A is referred to as pedestal (putter face) 6A) in a disassembled form, each of which construct the putter face, and (e) illustrates the hexagonal post 4, the impact-absorbing ring 5, and the pedestal 6B (however, (e) in FIG. 3 illustrates a partial cross sectional view of the pedestal 6B) illustrated in (d) of FIG. 3 in an assembled form.

Different to the putter face 2A, the putter face 2B adopts an arrangement in which four screw holes for setscrews (not illustrated) are provided so as to screw the putter face 2B to the putter head 1. Such an arrangement allows attachment of four screws for fixing the putter face 2B to the putter head (head) 1. This enables firm joining (fix and screw a screw to a screw hole) of the putter head 1 and the putter face 2B. However, proportional to the increase in the number of screw holes, surplus area on the face surface side of the putter face 2B increases as compared to the surplus area on the face surface side of the putter face 2A.

As illustrated in (a) and (b) of FIG. 3, the putter face 2B is constructed of a plurality of hexagonal posts 4, each made of material having a higher rigidity than a ball, and each having a contact surface (contact surface (pillar-shaped body) 41 later described) that has contact with the ball, and a plurality of impact-absorbing rings (elastic body) 5 each being attached to respective one of the hexagonal posts 4 so as to elastically support the hexagonal posts 4 in a normal direction of the contact surfaces 41, and made of material having a lower rigidity than that of the hexagonal posts 4.

In the present embodiment, the plurality of hexagonal posts 4 are arranged in a frame 3B so as to be juxtaposed in an in-plane direction of the contact surfaces 41 with no space between respective adjacent ones, and that the contact surfaces 41 of the plurality of hexagonal posts 4 constitute a single surface when the ball is not in contact with the contact surfaces.

Technically speaking, it is possible to interpret "juxtaposed with no space between respective adjacent ones" as including a case where the plurality of hexagonal posts 4 are juxtaposed so closely that the hexagonal posts 4 cannot move independently (the plurality of hexagonal posts 4 giving strong pressure against each other in the in-plane direction of the contact surface). However, the putter face 2B (or the putter face 2A) of the present embodiment is supposed so that the pressure given by the plurality of hexagonal posts 4 in the in-plane direction of the contact surface is small to a degree that the plurality of hexagonal posts 4 are independently movable.

Alternatively, it is also interpretable that each of the plurality of the hexagonal posts 4 are "juxtaposed with no space between respective adjacent ones" to a degree such that rotation of each of the plurality of hexagonal posts 4 in the in-plane direction of the contact surface is prevented. Namely, it is preferable for the plurality of the hexagonal posts 4 to be "juxtaposed with no space between respective adjacent ones" from a view of improving area efficiency of the face surface while keeping independence in movement of the plurality of hexagonal posts 4, and from a view of preventing rotation in the in-plane direction.

The following description explains materials of each element that construct the putter face 2B. In the present embodiment, stainless steel of a JIS standard SUS303 is used as material of the frame 3B illustrated in (a) of FIG. 3. However, the material of the frame 3B is not limited to the stainless steel of the JIS standard SUS303, and it is possible to use other various types of stainless steel which belong to one of martensic, ferritic, austenitic, austenitic-ferritic, and precipitation hardening stainless steel, each of which in other standards. The material is also not limited to alloys which include Fe such as the stainless steel, and materials such as titanium alloys which contain titanium, other various alloys, and other metals are used as appropriate.

The face surface side of the frame 3B is provided with an insertion hole having a zigzag circumference, so as to fit an appropriate number of hexagonal posts 4 without any space between respective adjacent hexagonal posts 4. Such an arrangement allows a stable putter face 2B, in a state in which the appropriate number of independent hexagonal posts 4 are juxtaposed with no space between the respective adjacent ones. As a result, an effect is attained such that a movable direction of the hexagonal posts 4 is derived to a perpendicular direction with respect to the face surface (normal direction of the contact surfaces 41).

Next, as illustrated in (d) of FIG. 3, the hexagonal posts 4 are composed of a head section which has the contact surfaces 41, an intermediate section (pillar-shaped body) 42 of a cylindrical shape, and a conical section (engaging section, pillar-shaped body) 43 of a conical shape. The shape of the intermediate section 42 and the conical section 43 are not particularly limited to the cylindrical shape and the conical shape, respectively, and may be of any shape as long as a respective function is fulfilled.

In the present embodiment, the stainless steel of the JIS standard SUS303 is used as the material of the frame 3B illustrated in (a) of FIG. 3. However, the material of the frame 3B is not limited to the stainless steel of the JIS standard SUS303, and it is possible to use other various types of stainless steel which belong to one of martensic, ferritic, austenitic, austenitic-ferritic, and precipitation hardening stainless steel, each of which in other standards. Moreover, it is not limited to alloys which include Fe such as the stainless steel, and materials such as titanium alloys which contain titanium, other various alloys, and other metals are used as appropriate.

In comparison, as illustrated in (b) of FIG. 3, the pedestal 6B (see (c) of FIG. 3) is provided on a side opposed to the contact surfaces 41 (back side of the view illustrated in (a) of FIG. 3), the pedestal 6B having a plurality of inserting holes (holes) 61 in which the hexagonal posts 4 are inserted and fitted, respectively, slidably in a normal direction of the contact surfaces 41, so as to engage the hexagonal posts 4 with the pedestal 6B.

As illustrated in (d) of FIG. 3, the plurality of hexagonal posts 4 are, slidably in the normal direction of the contact surfaces, inserted and fitted in a plurality of inserting holes 61, respectively, which inserting holes (holes) 61 are provided in the pedestal 6B that is provided on a side opposite to the contact surfaces 41, and the hexagonal posts 4 include conical sections 43, respectively, via which the hexagonal posts 4 engage with the pedestal 6B.

According to this arrangement, the hexagonal posts 4 can be inserted and fitted to respective plurality of inserting holes 61 provided on the pedestal 6B that is provided on a side opposite to the contact surfaces 41 of the putter face 2B, in the normal direction of the contact surface 41. Therefore, it is possible to derive a shifting direction of the hexagonal posts 4 in a normal direction of the contact surface 41, while preventing the hexagonal posts from slipping out from the putter face 2B.

A side of the frame 3B opposite of the face surface side is counter bore processed so that the pedestal 6B fits in the frame 3B. The pedestal 6B illustrated in (c) of FIG. 3 has six projecting sections. These projecting sections work as stoppers so as to prevent the pedestal 6B from falling off to the face surface side, when the frame 3B is engaged with the pedestal 6B.

Note that the present embodiment adopts propylene for the material of the pedestal 6B (or the pedestal 6A corresponding to the putter face 2A), however it is not limited to this, and synthetic resin of organic polymers which have other carbons as their framework (e.g. polyvinyl chloride, polyethylene, and phenol resin) may also be used.

As for material of the impact-absorbing ring (elastic body) 5, the present embodiment adopts chloroprene rubber (neoprene (registered trademark) CR70, CR80, or CR90), however it is not limited to this, and may use synthetic rubber of an inorganic polymer having another carbon as its framework, natural rubber, and the like. In addition, it is also possible to use inorganic polymer silicon rubber having silicon as its framework.

Details on an effect attained by adjusting physical property of the impact-absorbing ring 5 is later explained.

The following description explains arrangements and an assembling method of the hexagonal posts 4, the impact-absorbing ring 5, and the pedestal 6B, with reference to (d) and (e) of FIG. 3. As illustrated in (d) of FIG. 3, upper surfaces of the hexagonal posts 4 are the contact surfaces 41 that have contact with the ball 7. The present embodiment adopts a regular hexagonal shape having a shortest diameter of 3 mm. Namely, the face surface of the putter face 2A is of a honeycomb structure which has the plurality of hexagonal posts 4 juxtaposed with no space between respective adjacent ones. Other than the hexagonal shape, the shape of the contact surface is preferably a regular triangle, or a parallelogram.

As described above, by thus having each of the contact surfaces 41 having a shape of the regular triangle, the parallelogram, or the hexagon, it is possible to juxtapose the identically-shaped contact surfaces 41 with no space between respective adjacent ones, so as to constitute a single surface (face surface). That is to say, a number of contact surfaces 41 per area is maximized for each shape. Therefore, it is possible to maximize the effect of the present invention with respect to the shape of the contact surfaces 41. In order to particularly maximize an effect of the present invention, it is preferable to arrange the face surface in a honeycomb structure of the present embodiment, that is, to have the shape of each of the contact surfaces 41 as the regular hexagonal shape. This is because, in order to enhance symmetric property of a regular n polygon (n is a natural number), it is necessary to have a large number of n; the largest number possible of n for a regular n polygon which can juxtapose identically-shaped contact surfaces with no space between the respective adjacent ones so as to constitute a single plane is 6 (i.e., n=6).

A circle has a highest symmetric property, and it is also possible to adopt a circle as the shape of the contact surface 41. In such a case, although it is not possible to juxtapose the contact surfaces 41 with no space between the respective adjacent ones so as to constitute a single surface, it is possible to maximize motion performance of each pillar-shaped body and dynamic balance with respect to the whole face.

Moreover, the parallelogram, from its property that a sum of the opposing interior angle adds up to 180°, is considered that it is possible to juxtapose identical parallelogram-shaped contact surfaces on a plane surface. Needless to say, a rhombus, a rectangle, a square and the like are included in the parallelogram.

Further, in a case where it is possible to juxtapose the contact surfaces 41 with no space between the respective adjacent ones so as to constitute the plane surface, there is just one arrangement pattern for the plurality of pillar-shaped bodies. However, if there is a space, a plurality of arrangement patterns can be considered. Therefore, troublesome work in order to find a best pattern in the plurality of arrangement patterns occurs.

As such, in a case where the plane surface cannot be juxtaposed with the contact surfaces 41 with no space between the respective adjacent ones, work efficiency of the creation of the putter face is likely to significantly decrease. Therefore, if the shape of the contact surfaces 41 is one of the regular triangle, the parallelogram, or the regular hexagon, it is possible to maximize the work efficiency of the putter face creation. Moreover, if the plane surface is juxtaposed with the contact surfaces 41, there is no possibility of waste coming into the face thereby causing a need to take away the waste.

It is preferable for the maximum diameter of the contact surfaces 41 to be not more than 5 mm.

A size and number of dimples of a golf ball is set in advance. Therefore, if the diameter of the contact surfaces 41 exceeds 5 mm, it is difficult to have a sufficient number of contact surfaces (or contact points) with respect to the ball, and therefore becomes hard to attain the effect of the present invention. In the case where the diameter is not more than 5 mm, a shorter diameter is more preferred.

Next is the assembling method of the hexagonal post 4, the impact-absorbing ring 5, and the pedestal 6B, as illustrated in (e) of FIG. 3. As illustrated in (e) of FIG. 3, the conical section 43 of the hexagonal post 4 is inserted through the impact-absorbing ring 5, respectively. The impact absorbing ring 5 is positioned so as to be within an intermediate section 42 of the hexagonal post 4.

Then, the conical section 43 of the hexagonal post 4 is slidably inserted to a respective plurality of inserting holes 61. At this time, a diameter of a bottom circle of the conical section 43 of the hexagonal post 4 is greater than a diameter of the inserting holes 61 on the pedestal 6B. Therefore, when the hexagonal posts 4 is pressed into (or inserted to) the inserting hole 61 of the pedestal 6B, the outer circumference section of the bottom circle of the conical section 43 becomes caught in the inserting hole 61. As such, the hexagonal posts 4 are engaged to the pedestal 6B. This thus enables an arrangement where the hexagonal posts 4 are not readily slipped out of the pedestal 6B.

Figure 4:
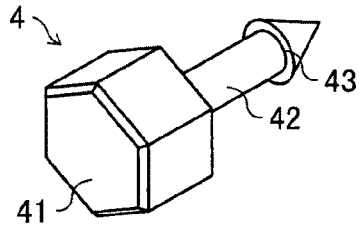
FIG. 4 is a diagram schematically illustrating an arrangement of a hexagonal post which constructs a putter face to be inserted to the putter head, wherein (a) is a perspective view illustrating an arrangement of the hexagonal post which constructs the putter face, (b) is an example of a side view of the hexagonal post from an angle perpendicular to a longitudinal direction of the hexagonal post, (c) is an upper view (contact surface side) of the hexagonal post; (d) is another example of a side view of the hexagonal post from an angle perpendicular to a longitudinal direction of the hexagonal post, and (e) is a bottom view of the hexagonal post.
Figure 4:
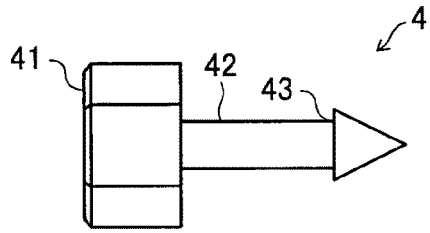
Figure 4:
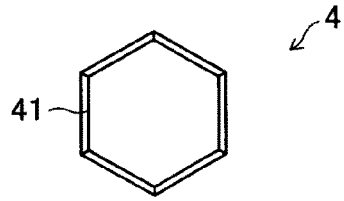
Figure 4:
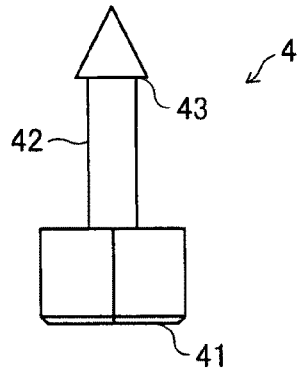
Figure 4:
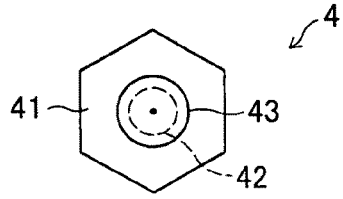
Figure 5:
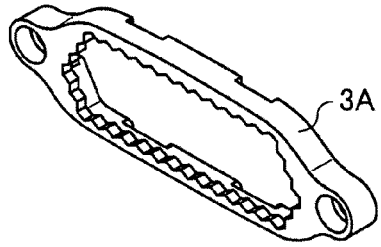
FIG. 5 is a diagram schematically illustrating a frame of the putter face, which frame has no hexagonal post inserted therein, wherein (a) illustrates a diagonal view of a frame of the putter face, which frame has no hexagonal post inserted therein, (b) illustrates a diagonal view of a frame in which hexagonal posts are inserted therein, (c) illustrates an upper view of a frame from a face surface side, (d) illustrates a bottom view of the frame, (e) illustrates a side view of the frame in a state in which a face surface side is facing downwards, (f) illustrates a side view of the frame in a state in which a face surface side is facing upwards, (g) illustrates a right side view (symmetrical to a left side view) of the frame, and (h) illustrates a cross sectional view taken on a line A-A as illustrated in (c).
Figure 5:
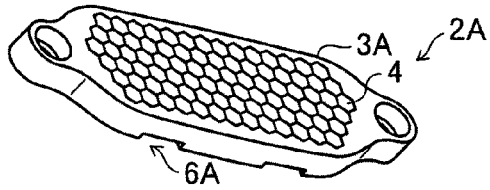
Figure 5:
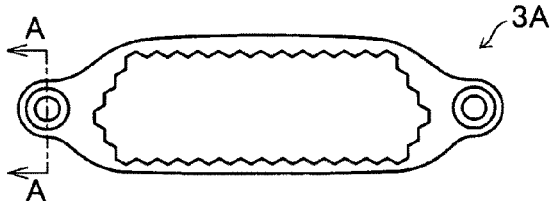
Figure 5:
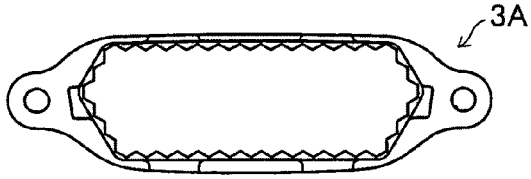
Figure 5:
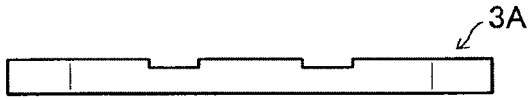
Figure 5:
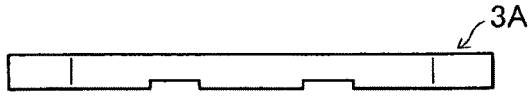
Figure 5:
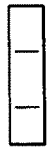
Figure 5:
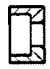
Figure 6:
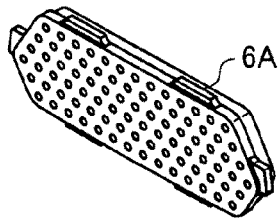
FIG. 6 is a diagram schematically illustrating a pedestal of the putter face, which pedestal has no hexagonal post inserted therein, wherein (a) illustrates a diagonal view of a pedestal of the putter face, which pedestal has no hexagonal post inserted therein, (b) illustrates an upper view of a pedestal having the face surface side as front, (c) illustrates a bottom view of the pedestal, (d) illustrates a side view of the pedestal in a state in which a side closer to a face surface is facing upwards, (e) illustrates a side view of the pedestal in a state in which a side closer to the face surface is facing downwards, (f) illustrates a right side view in a state in which a side closer to a face surface is facing right, (g) illustrates a cross sectional view taken on a line A-A illustrated in (b), and (h) illustrates a left side view in a state in which a side closer to a face surface is facing left.
Figure 6:
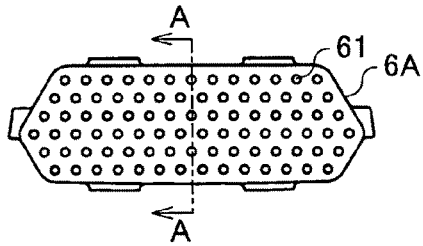
Figure 6:
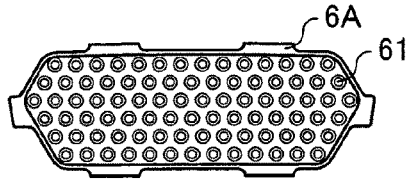
Figure 6:
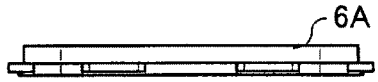
Figure 6:
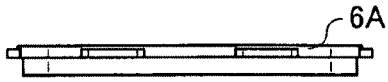
Figure 6:
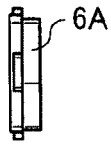
Figure 6:
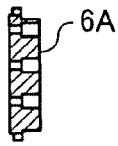
Figure 6:
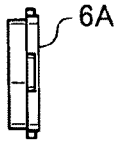

The following description specifically illustrates an arrangement of the hexagonal posts 4, the frame 3A, and the pedestal 6A (here, the frame 3A and the pedestal 6A are explained instead of the frame 3B and the pedestal 6B), with respect to FIGS. 4 through 6.

In FIG. 4, (a) is a diagonal view illustrating an arrangement of a hexagonal post 4, (b) is an example of a side view of the hexagonal post 4 from an angle perpendicular to a longitudinal direction of the hexagonal post 4, (c) is an upper view (contact surface 41) of the hexagonal post 4, (d) is another example of a side view of the hexagonal post 4 from an angle perpendicular to a longitudinal direction of the hexagonal post 4, and (e) is a bottom view of the hexagonal post 4.

In FIG. 5, (a) illustrates a diagonal view of a frame 3A of the putter face 2A which frame 3A has no hexagonal post 4 inserted therein, (b) illustrates a diagonal view of the frame 3A in which hexagonal posts 4 are inserted therein, (c) illustrates an upper view of the frame 3A from a face surface side, (d) illustrates a bottom view of the frame 3A, (e) illustrates a side view of the frame 3A in a state in which a face surface side is facing downwards, (f) illustrates a side view of the frame 3A in a state in which a face surface side is facing upwards, (g) illustrates a right side view (symmetrical to a left side view) of the frame 3A, and (h) illustrates a cross sectional view taken on a line A-A as illustrated in (c).

In FIG. 6, (a) illustrates a diagonal view of the pedestal 6A of the putter face 2A, which pedestal has no hexagonal post 4 inserted therein, (b) illustrates an upper view of the pedestal 6A from a face surface side, (c) illustrates a bottom view of the pedestal 6A, (d) illustrates a side view of the pedestal 6A in a state in which a face surface side is facing upwards, (e) illustrates a side view of the pedestal 6A in a state in which a face surface side is facing downwards, (f) illustrates a right side view of the pedestal 6A in a state in which a face surface side is facing right, (g) illustrates a cross sectional view taken on a line A-A illustrated in (b), and (h) illustrates a left side view of the pedestal 6A in a state in which a face surface side is facing left.

Figure 7:
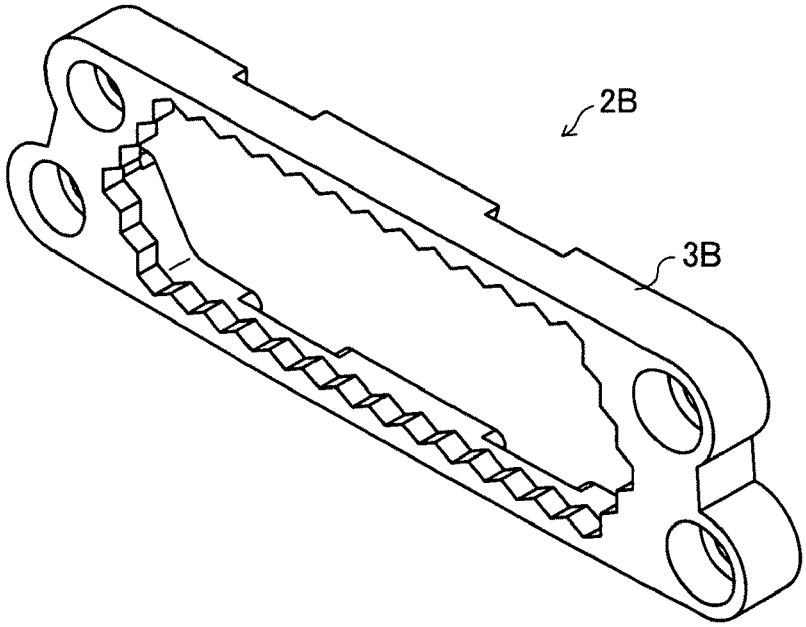
FIG. 7 is a diagram schematically illustrating another example of a putter face (a frame which has no hexagonal post inserted therein) to be inserted to the putter head, wherein (a) illustrates a diagonal view of the another example of a putter face (a frame which has no hexagonal post inserted therein) and (b) illustrates a diagonal view of the another example of a putter face (a frame which has hexagonal posts inserted therein).
Figure 7:
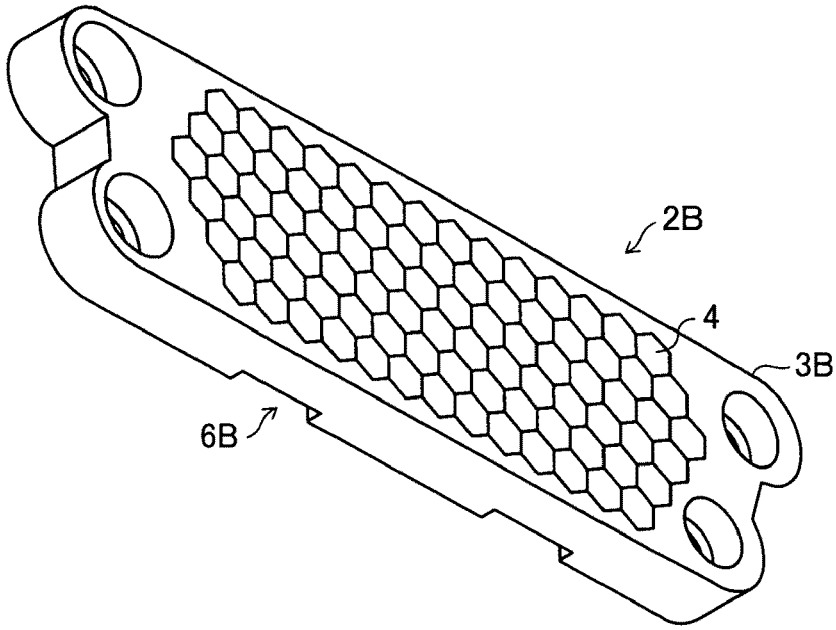

Moreover, in FIG. 7, (a) illustrates a diagonal view of the putter face 2B to be inserted to the putter head 1 (the frame 3B in which no hexagonal post 4 is inserted therein) and (b) illustrates a diagonal view of the putter face 2B (the frame 3B in which the hexagonal posts 4 are inserted therein).

Second Embodiment

Another embodiment of the present invention is described below with respect to FIGS. 8 and 9. The arrangement other than what is explained in the present embodiment is the same as First Embodiment. In addition, for convenience, members having identical functions to the members illustrated in the figures of First Embodiment have the same reference numerals thereto, and their explanations are omitted here.

Figure 8:
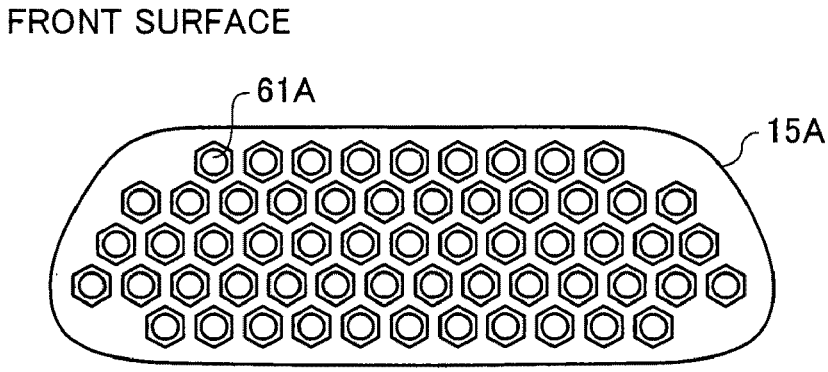
FIG. 8 is a diagram schematically illustrating another embodiment of a putter face (in which no hexagonal post is inserted) in the present invention, wherein (a) schematically illustrates an upper view (face surface side) of another embodiment of a putter face (in which no hexagonal post is inserted) in the present invention, (b) illustrates a bottom view (a side opposite of the face surface) of the putter face, and (c) illustrates a cross sectional view from a side (a face surface facing upwards) of the putter face.
Figure 8:
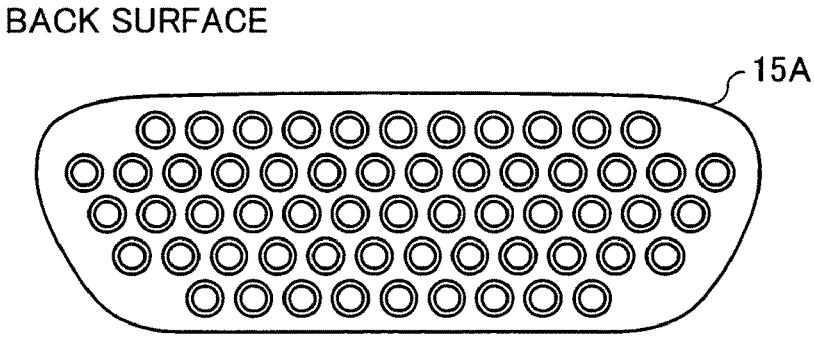
Figure 8:
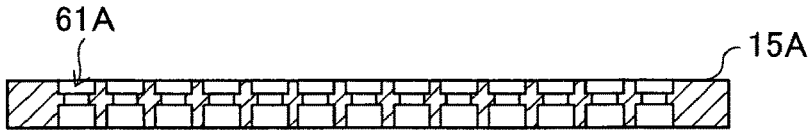

In FIG. 8, (a) schematically illustrates an upper view (face surface side) of a putter face 12A (in which no hexagonal post 4A is inserted) which is another embodiment of the present invention, (b) illustrates a bottom view (a side opposite a face surface) of the putter face 12A, and (c) illustrates a cross sectional view from a side (a face surface side facing upwards) of the putter face 12A.

Figure 9:
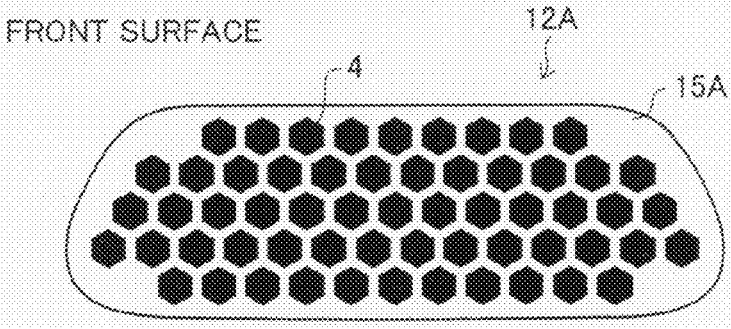
FIG. 9 is a diagram schematically illustrating an arrangement of the putter face (in which hexagonal posts are inserted), wherein (a) schematically illustrates an upper view (face surface side) of the putter face (in which hexagonal posts are inserted), (b) illustrates a bottom view (a side opposite of the face surface) of the putter face, (c) illustrates a cross sectional view from a side of the putter face and an insertion method of a hexagonal post, (d) illustrates a cross sectional view from a side of the putter face and a view of the putter face which has hexagonal posts inserted therein, and (e) schematically illustrates an upper view (face surface side) of still another embodiment of a putter face (which has cylindrical posts inserted therein) in the present invention.
Figure 9:
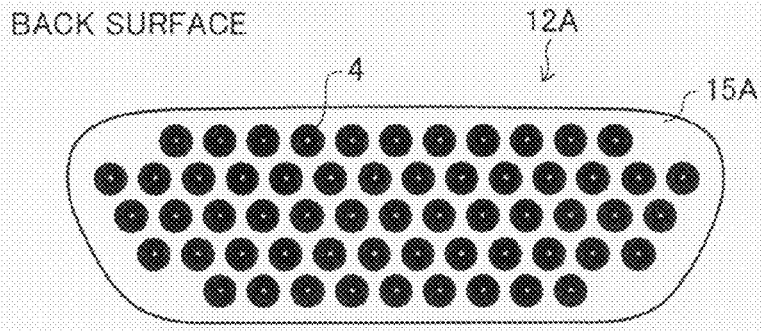
Figure 9:
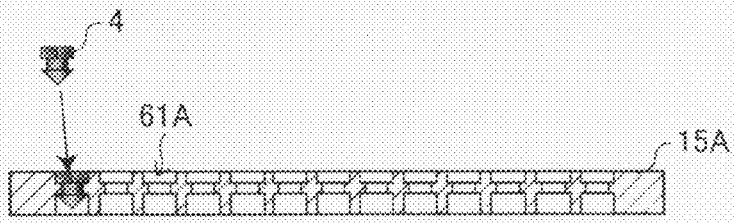
Figure 9:
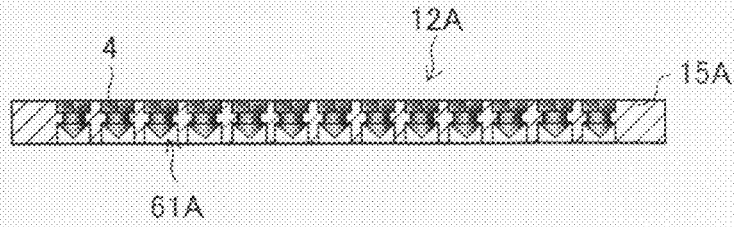
Figure 9:
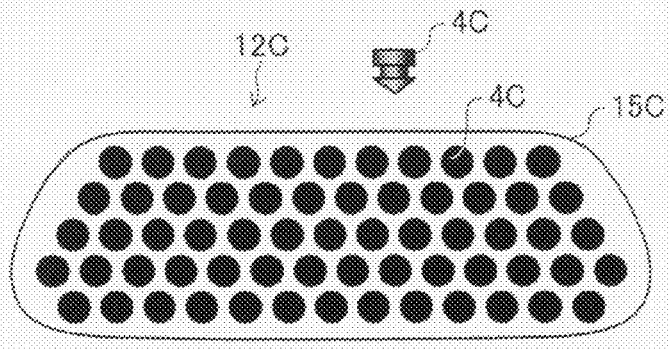

In FIG. 9, (a) schematically illustrates an upper view (face surface side) of the putter face 12A (in which hexagonal posts 4A are inserted), (b) illustrates a bottom view (a side opposing the face surface) of the putter face 12A, (c) illustrates a cross sectional view from a side of the putter face 12A and an insertion method of hexagonal posts 4, (d) illustrates a cross sectional view from a side of the putter face 12A and a view of the putter face 12A in which hexagonal posts 4A are inserted therein, and (e) schematically illustrates an upper view (face surface side) of a putter face 12C (which has cylindrical posts 4C inserted therein) which is still another embodiment of the present invention.

As illustrated in FIG. 9, from (a) through (d), the putter face 12A of the present embodiment includes a urethane base (elastic body) 15A and hexagonal posts (pillar-shaped body) 4A.

In First Embodiment, an impact-absorbing ring (elastic body) 5 is attached to each of the hexagonal posts 4. The putter face 12A of the present invention is different to First Embodiment in that the elastic body is a one urethane base 15A.

As like the putter face 12A, an arrangement in which the urethane base 15A is attached to each of the hexagonal posts 4A may be applied.

Note that the arrangement, materials and the like of the hexagonal posts 4A are the same as the hexagonal posts 4 of First Embodiment; therefore explanation thereof is omitted here.

In the present embodiment, an elastic body which uses urethane resin is given as an example, however other resin such as elastomer and the like may also be applied.

The urethane base 15A is made of material having a lower rigidity than the hexagonal posts 4A, and elastically supports the hexagonal posts 4A in a normal direction of the contact surfaces.

According to the arrangement, as similar to the putter faces 2A and 2B of First Embodiment, independency in movement for each of the hexagonal posts 4A is expected to decrease as compared to a case where the plurality of hexagonal posts 4 have the plurality of impact-absorbing rings 5 attached, respectively. However, the elastic body is just the urethane base 15A, and therefore can be easily produced.

The putter face 12A does not have a screw hole, as different to the putter faces 2A and 2B. Attachment methods of the putter face 12A to the putter head include, for example, a method of fitting the putter face 12A to a head part which is counter bored, and also adhesion and welding. The putter face 12A may be colored in an arbitrary color.

The plurality of hexagonal posts 4A are juxtaposed in an in-plane direction of the contact surface on the urethane base 15A, and the contact surfaces of the hexagonal posts 4A constitute a single surface when a ball is not in contact with the contact surfaces.

Note that in the putter face 12A of the present embodiment, a comparatively highly rigid urethane base 15A is used, and the hexagonal posts 4A are nailed down (pressed, inserted) to the inserting holes 61A.

At this time, a diameter of a base circle of the conical section (see the conical section 43 of the hexagonal post 4 in First Embodiment) of the hexagonal posts 4A is longer than a diameter of the inserting holes 61A. Therefore, when the hexagonal posts 4A are pressed in (or inserted to) the respective inserting holes 61A, a circumferential section of the bottom circle of the conical section of the hexagonal posts 4A becomes caught in the inserting holes 61A. Therefore, it is possible to engage the hexagonal posts 4A to the urethane base 15A. As such, it is possible to prevent the hexagonal posts 4A from easily slipping out from the urethane base 15A.

A shape of the inserting holes 61A is set along with the shape of the hexagonal posts 4A. Therefore, it is possible to prevent rotation of the hexagonal posts 4A in the in-plane direction of the contact surface.

As illustrated in (c) and (d) of FIG. 9, the urethane base 15A has a plurality of inserting holes (holes) 61A in which the plurality of hexagonal posts 4A are inserted and fitted, respectively, slidably in a normal direction of the contact surfaces, so as to engage the plurality of hexagonal posts 4A with the urethane base 15A.

This arrangement allows inserting/fitting of the plurality of hexagonal posts 4A in the plurality of inserting holes 61A provided on the urethane base 15A, respectively, slidably in a normal direction of the contact surfaces. Therefore, it is possible to derive the shifting direction of the hexagonal post 4A in the normal direction of the contact surface, while preventing the sliding out of the hexagonal posts 4A.

Moreover, as illustrated in (a) of FIG. 9, the present embodiment has a space provided between respective adjacent contact surfaces of the plurality of hexagonal posts 4A.

According to the arrangement, it is possible to enhance the independency of the elastic motion of each of the plurality of hexagonal posts 4A, by providing a space between respective adjacent contact surfaces of the plurality of hexagonal posts 4A so as to appropriately adjust spacing between the respective adjacent hexagonal posts 4A.

The present embodiment explains the case where hexagonal posts 4A as similar to the hexagonal posts 4 in First Embodiment is adopted as an example of the pillar-shaped body. However, cylindrical posts 4C, as like a putter face 12C illustrated in (e) of FIG. 9 may also be adopted as an example of the pillar-shaped body.

In such a case, it is possible to maximize motion performance of the cylindrical posts 4C and dynamic balance with respect to the whole face. In addition, even if the cylindrical posts 4C rotate in an in-plane direction of the contact surface, an outer appearance is not disfigured, since the contact surfaces are circular.

Note that in a case a polygon is to be adopted, adoption of a regular hexagon as like in the hexagonal posts 4A (so-called honeycomb structure) enables to maximize an area of which the pillar-shaped bodies occupy the putter face 12A or 12C as a whole, as compared to adopting other polygons or a circle.

[Physical Mechanism and Verification of Putter Face]

Next is an explanation of various physical mechanisms of a putter face, with respect to FIGS. 10 through 14. The putter face 2A and the putter face 2B in First Embodiment (hereinafter, the putter faces 2A and 2B are together referred as putter face 2) are given as examples.

Figure 10:
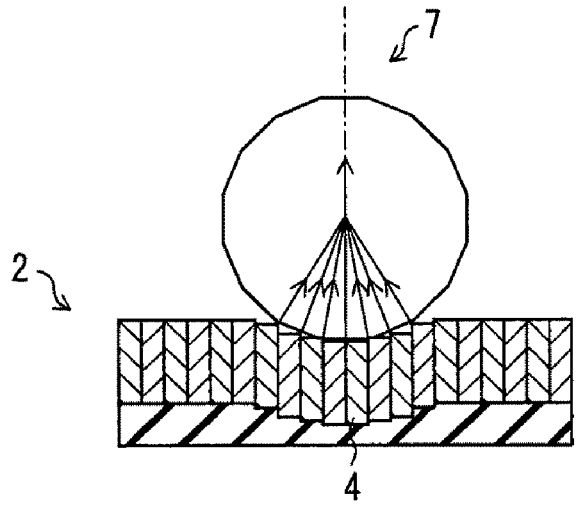
FIG. 10 is a schematic diagram for explaining a physical mechanism of the putter face and a metal putter face, wherein (a) illustrates a physical mechanism of the putter face, and (b) illustrates a physical mechanism of a metal putter face.
Figure 10:
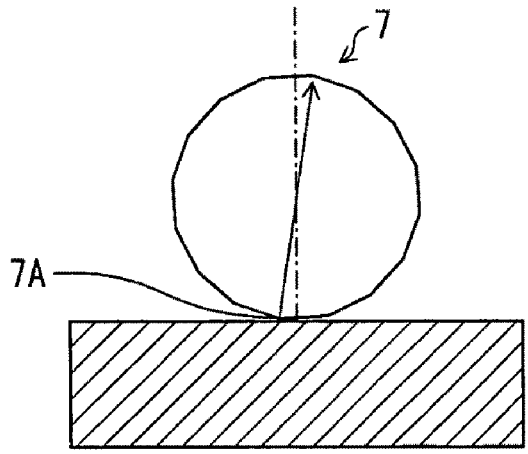

In FIG. 10, (a) illustrates a physical mechanism in which a shift of a rebounding direction of a ball 7 is prevented due to a point contact of the putter face 2 on a dimple edge section 7A (not illustrated) on a surface of the ball 7, and (b) illustrates a physical mechanism of a metal putter face.

Until there is contact with the ball 7, the plurality of hexagonal posts 4 are juxtaposed in an in-plane direction of the contact surfaces 41 so that the contact surfaces 41 of the hexagonal posts constitute a single surface when the ball 7 is not in contact with the contact surfaces 41.

That is to say, assume a case where a ball collides on a face surface in a perpendicular direction to the face surface, in an initial condition that the contact surfaces 41 constitute a single surface when the ball 7 is not in contact with the contact surfaces 41. Note that, from motion relativity, this alternatively can be considered as having the ball 7 collide on the face surface of a still golf putter instead of striking a still ball 7 by use of the golf putter. In such a case, in the putter face 2, as illustrated in (a) of FIG. 10, the impact absorbing rings 5 elastically deform in a normal direction of the face surface (contact surfaces 41), thereby allowing the contact surfaces 41 of the plurality of the hexagonal posts 4 to have contact with a plurality of places on the surface of the ball 7 (the face surface deforms so that the contact surfaces 41 are alongside the surface of the ball 7).

Moreover, it is expected that the contact surfaces 41 isotropically deform about its center which is a contact point of the ball 7 and the face surface (assumedly substantially matching an intersection of a central axis of the ball in the normal direction of the face surface and the face surface), due to spherical symmetry of the ball 7. Note that this isotropic deformation of the contact surfaces 41 would still be attained even if deformation of the ball 7 occurs.

In view of this, it is expected that all of repulsion vectors (reaction vectors) which have effect on the contact sections on the contact surfaces 41 of the ball 7 are accurately directed to a vicinity of a predetermined point on a central axis of the ball 7 in the normal direction of the face surface, as illustrated in (a) of FIG. 10. In addition, a resultant vector of these is accurately directed to a direction along the central axis, that is, the normal direction of the face surface. The ball 7 receives force in a direction along the resultant vector, therefore the ball 7 accurately rolls in the direction along the resultant vector, that is, the normal direction of the face surface.

For simplification, in (a) of FIG. 10, the deformation of the ball 7 is ignored, and is illustrated so that all of the repulsion vectors are accurately directed to the vicinity of the center of the ball 7. However, the resultant vector is expected to be accurately directed to the direction along the central axis, regardless of the deformation of the ball 7, as a result of considering the initial conditions such as the symmetry of the ball 7, the fact that the ball 7 collides on the face surface perpendicular to the face surface, and that the contact surfaces 41 constitute a single surface when the ball 7 is not in contact with the contact surfaces 41.

Strictly speaking, in a collision phenomenon, it is necessary to solve an equation of motion in which a difference in momentum vector before and after colliding to the ball 7 is equal to an integral of an impulse vector of which the ball 7 has received, and complex simultaneous equations such as a relational expression between a coefficient of restitution of the face surface and a change in velocity before and after colliding with the ball 7. However, qualitatively, the direction of the resultant vector is considered such that during the collision, the direction of the resultant vector is hardly shifted from the direction along the central axis. Therefore, it is expected that the above conclusion be attained.

Therefore, as described above, with the putter face 2 (putter faces 2A and 2B), the contact surfaces 41 of the plurality of hexagonal posts 4 have contact with the ball 7 in a plurality of places on the surface of the ball 7 so that the contact surfaces are alongside the surface of the ball 7. Therefore, the occurrence of shift of a rebounding direction of the ball 7 caused by the point contact with the dimple edge part 7A on the surface of the ball 7 is prevented.

On the other hand, as illustrated in (b) of FIG. 10, with a hard metal putter face, a face surface hardly deforms even if the ball 7 has contact with the face surface, due to its rigidity. In such a case, as illustrated in (b) of FIG. 10, when the face surface has point contact with the dimple edge part 7A on the surface of the ball 7, it is expected that a motion state becomes one which its initial condition is a state in which the dimple edge part 7A on the surface of the ball 7 is in point contact. Therefore, with the hard metal putter face, it is not possible to prevent the occurrence of shift of a rebounding direction of the ball 7, which shift is caused by the point contact of the dimple edge part 7A on the surface of the ball 7.

Figure 11:
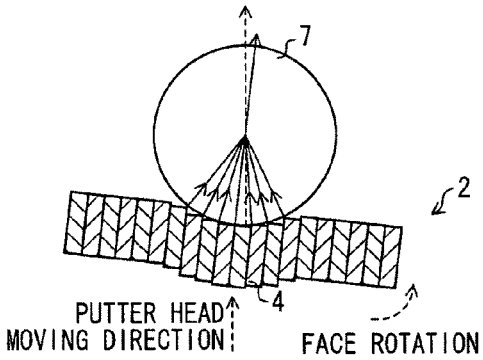
FIG. 11 is a schematic diagram for explaining a physical mechanism of the putter face and a metal putter face, wherein (a) illustrates a physical mechanism of the putter face, (b) similarly illustrates a physical mechanism of the putter face, (c) illustrates a physical mechanism of a metal putter face, and (d) similarly illustrates a physical mechanism of a metal putter face.
Figure 11:
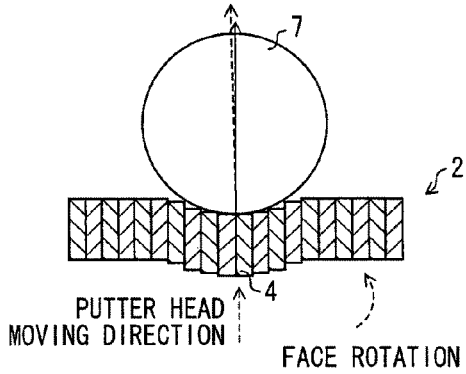
Figure 11:
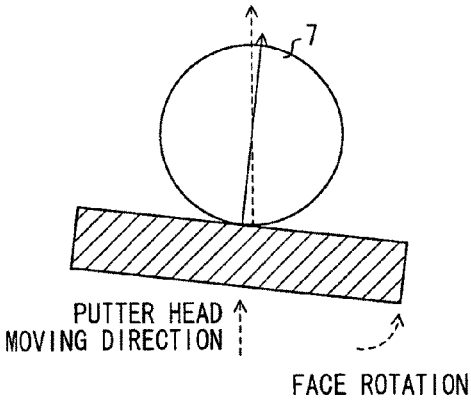
Figure 11:
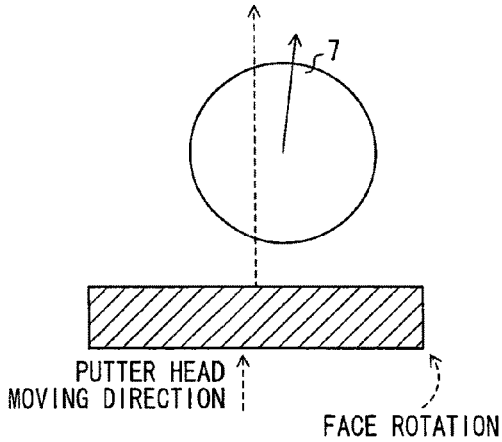

In FIG. 11, (a) illustrates a physical mechanism which can accurately strike the ball 7 in an aimed direction while compensating a slight angle slide of the face surface. This physical mechanism corrects a striking direction of the ball 7 so that the ball 7 moves towards the aimed direction even if a face rotation motion occurs to the putter face 2. In addition, (b) in FIG. 11 illustrates a physical mechanism of the putter face 2 as similar to (a). (c) in FIG. 11 illustrates a physical mechanism of a metal putter face, and (d) in FIG. 11 illustrates a physical mechanism of the metal putter face as similar to (c).

A phenomenon called face rotation is often raised as a problem. This face rotation is a phenomenon such that, even if the ball 7 is impacted provided that a moving direction of the putter head 1 visually matches with the normal direction of the face surface of the putter face (or the contact surfaces of the plurality of pillar-shaped bodies), a progressing direction of the ball 7 is shifted off from a moving direction of the putter head (aimed direction) due to the arrangement of the golf putter.

This phenomenon is caused by having two elliptic trajectories: (1) a striking trajectory of the putter head (an elliptic trajectory in a substantially perpendicular direction with respect to the putter head); and (2) a rotational trajectory of the putter head in line with a user's body (an elliptic trajectory in a substantially horizontal direction with respect to a face surface seen from above), be combined into one complex trajectory, as a trajectory of the face surface of the golf putter. As a result, the face surface has contact with the ball 7 in a direction that is shifted off from a direction perpendicular to the face surface (aimed direction) at the time of the impact, even though the normal direction of the face surface and the moving direction of the putter head visually match with each other.

Moreover, at the time of the impact on the ball 7, a motion to return the face is often carried out by naturally synchronizing with a wrist movement. However, in such a case, the face surface rotates about an axis which runs substantially along a shaft of the golf putter. When this rotating movement is further added to the two elliptic movements, the face rotation becomes more intense.

In comparison, as illustrated in (a) of FIG. 11, with the putter face 2, the face surface (plurality of a hexagonal posts 4) deforms at the moment of impact so as to have a longer contact time between the ball 7 and the face as compared to the golf putter having a metal face as illustrated in (c) and (d) of FIG. 11, even if the face surface of the putter face 2 has contact with the ball 7 in an angle shifting off a perpendicular direction with respect to the ball 7 caused by the face rotation movement.

The reaction received from the face surface of the golf putter during the contact time is further divided into (i) normal force (not illustrated) in a perpendicular direction of the face surface and (ii) friction (not illustrated) in the in-plane direction of the face surface. In theory, this friction has a component which causes the ball 7 to correct its progressing direction so as to follow a moving direction (aimed direction) of the putter head 1 (impede the ball 7 from shifting off sideways with respect to the face surface) due to the direction of the reaction received from each of the contact surfaces 41, as a result of elastic deformation of the face surface, as illustrated in (a) of FIG. 11. Therefore, it is thought that the striking direction of the ball is corrected before the ball 7 separates from the face surface, so that the ball 7 is closer than the aimed direction, as illustrated in (b) of FIG. 11.

Here, the putter head made of metal is regarded as a rigid body whose face surface does not deform. Therefore, the contact time of the ball and the face is short, and is considered that hardly any friction occurs with the putter head made of metal. As such, as illustrated in (c) and (d) of FIG. 11, it is considered that the striking direction of the ball 7 cannot be corrected to the aimed direction (moving direction of the putter head).

On the other hand, in the putter face 2, each of the plurality of hexagonal posts 4 is elastically deformable, as illustrated in (a) and (b) of FIG. 11. Therefore, at the time of the impact, the face surface deforms so as to be alongside the surface of the ball 7, thereby having contact with a plurality of places on the ball 7. Therefore, as described above, along with a long contact time between the ball 7 and the face, it is expected that sufficient friction occurs on the ball 7 as compared to the putter head made of metal as illustrated in (c) and (d) of FIG. 11. Consequently, as illustrated in (b) of FIG. 11, it is considered that the ball 7 can be struck in a striking direction close to a moving direction of the putter head 1.

Thus, caused by the effect of the friction, the striking direction of the ball 7 is corrected so as to be closer to the aimed direction than that of a hard metal putter face. Therefore, it is possible to accurately strike the ball 7 in the moving direction (aimed direction) while compensating a slight angle slide of the face.

In other words, it is assumed that since a component of friction that corrects a shift in a striking direction of the ball 7 from the moving direction of the putter head 1 (aimed direction) is sufficiently provided with respect to the impulse given to the ball 7, it is possible to prevent the occurrence of the shift of the striking direction of the ball 7 from the aimed direction.

It is believed that intermediate and advanced golf players are able to use different types of shots for different purposes. Particularly in putting, it is considered that subtle ball control is required. For example, there are many examples in which strengths and weaknesses (for example, a hook ball in which a ball hit by a right (left) player swerves to the left (right), and a slice ball which is the opposite of that) influences a result of a game.

Figure 12:
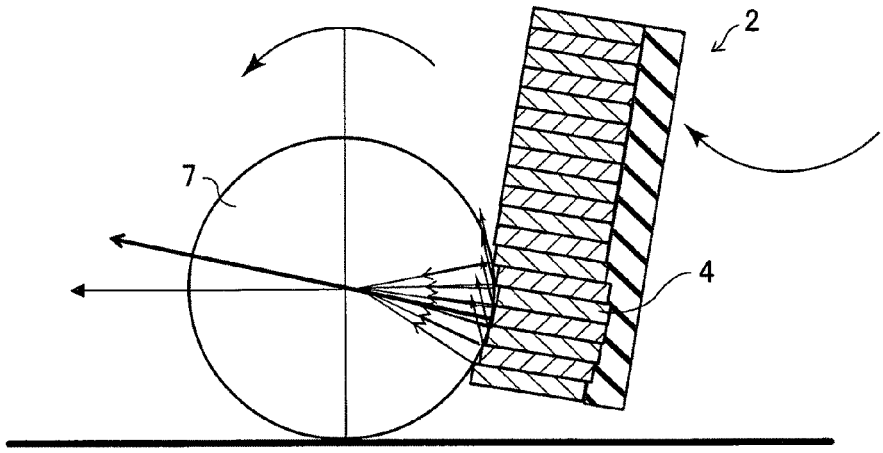
FIG. 12 is a schematic diagram for explaining a physical mechanism of the putter face, wherein (a) illustrates a physical mechanism of the putter face, (b) similarly illustrates a physical mechanism of the putter face, and (c) illustrates a ball rolling being applied a topspin.
Figure 12:
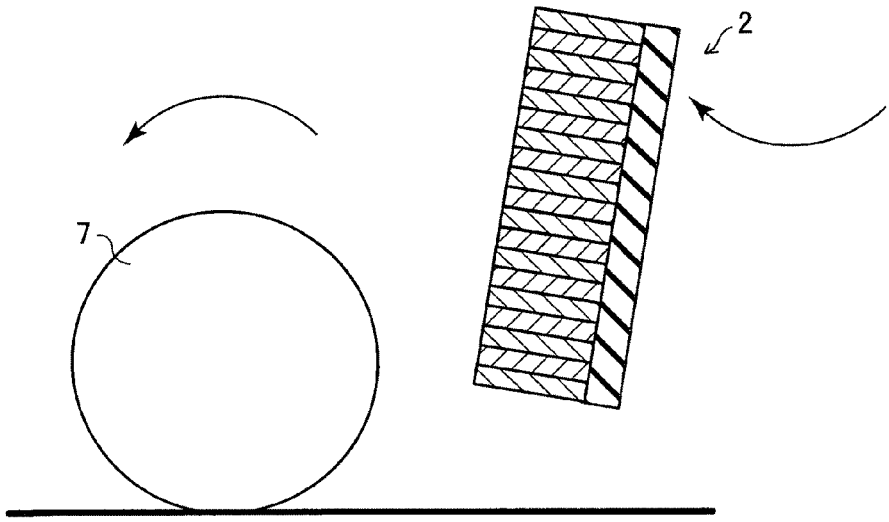
Figure 12:
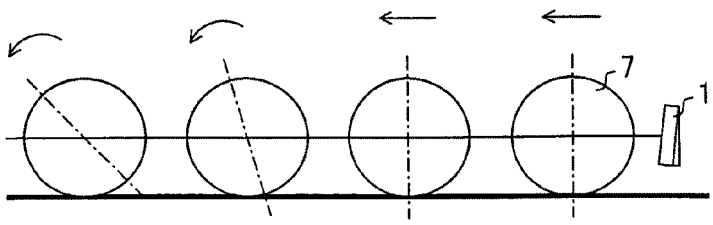

In FIG. 12, (a) illustrates a physical mechanism in which the putter face 2 can improve a ball control performance than the golf putter having a metal face, and (b) similarly illustrates a physical mechanism of the putter face 2.

With the putter face 2, when a ball has contact with the contact surfaces 41 of the plurality of hexagonal posts 4, the impact-absorbing rings 5 elastically deform in shape in a normal direction of the face surface (contact surfaces 41) so that the contact surfaces 41 have contact with a plurality of places on the surface of the ball 7.

Therefore, in the putter face 2, the face (the contact surfaces 41 of the plurality of hexagonal posts 4) deforms at the moment of the impact so as to have a longer contact time between the ball 7 and the face as compared to the golf putter having the metal face.

Moreover, as described above, the reaction received by the ball 7 from the face surface of the golf putter during the contact time is divided into (i) the normal force (not illustrated) in a perpendicular direction of the face surface and (ii) the friction (not illustrated) in the in-plane direction of the face surface. This friction is considered to be fairly great as compared to the golf putter having a hard metal face which is difficult to elastically deform (as a result, having a short contact time between the ball 7 and the face).

Accordingly, the golf putter and the putter face 2 of the present embodiment are sufficiently effected by the friction as compared to the golf putter having the metal face. This thus allows, as compared to the golf putter having the metal face, improvement of the ball control performance such as using various types of shots for different purposes such as the hook ball, and the slice ball opposite of the hook ball, improvement of propulsion to the aim by applying topspin to the ball, and further applying backspin (negative rotation) to the ball so that the ball stops on the green.

Note that (a) through (c) of FIG. 12 are schematic diagrams illustrating the ball 7 in which the golf putter or the putter face 2 is used so as to apply the topspin to the ball 7.

Figure 13:
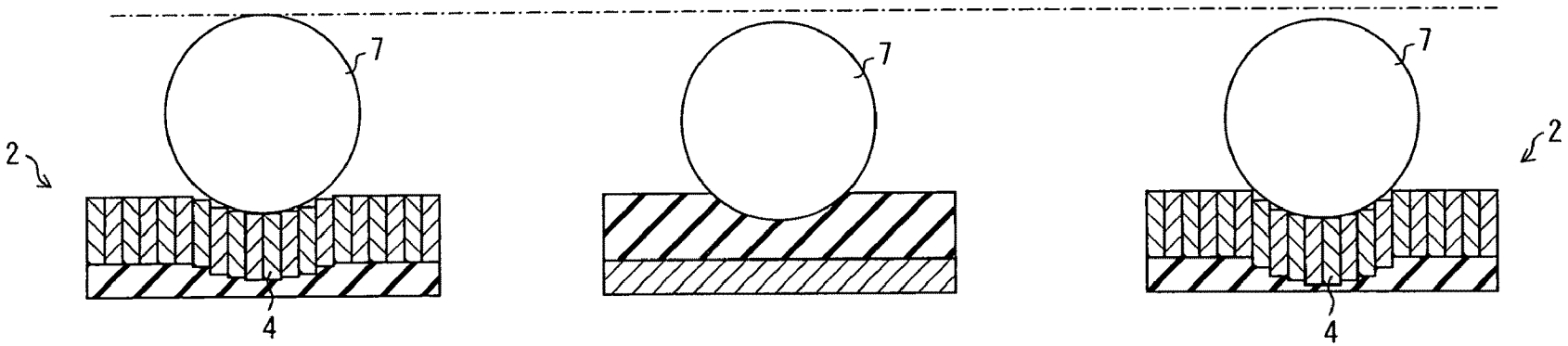
FIG. 13 is a schematic diagram for explaining a physical mechanism of the putter face and a resin putter face, wherein (a) illustrates a physical mechanism of the putter face, (b) illustrates a physical mechanism of a resin putter face, and (c) illustrates the physical mechanism of the putter face.

Next, in FIG. 13, (a) illustrates a physical mechanism of the putter face 2 which can attain an initial velocity, a striking touch, and sense of distance of a ball, each of which compare favorably to a metal face, (b) illustrates a physical mechanism of a resin putter face, and (c) illustrates a physical mechanism of the putter face 2.

As illustrated in (a) and (c) of FIG. 13, when a ball has contact with the contact surfaces 41 of the plurality of hexagonal posts 4, in the putter face 2, the impact-absorbing rings 5 elastically deform in a normal direction of the contact surfaces 41, thereby allowing the contact surfaces 41 of the plurality of the hexagonal posts 4 to have contact with a plurality of places on the surface of the ball 7 (the face surface deforms so that the contact surfaces 41 are alongside the surface of the ball 7).

As such, the contact surfaces 41 that have direct contact with the ball 7 have high rigidity (is unreadily deformed), and are arranged such that impact of a collision is indirectly absorbed by the elastic deformation of the impact-absorbing rings 5. As a result, a loss in coefficient of restitution is minimized as compared to a soft resin face (readily deformed) as illustrated in (b) of FIG. 13.

Namely, since the loss in the coefficient of restitution is small as compared to a face made of soft material such as resin, it is possible to attain, at a time of striking (the impact), an initial velocity that compares favorably with a metal face. Moreover, kinetic energy of the ball 7 is proportional to a square of the initial velocity. Therefore, loss in energy at the time of impact is also reduced. As a result, it is possible to attain a touch of striking (hereinafter referred to as simply "striking touch") and the sense of distance (rolling in accordance with the touch), each of which are compared favorably with the metal face.

At the time of the impact, the contact surfaces 41 of the hexagonal posts 4 made of the material having the higher rigidity than the ball 7 collides with the ball 7. This thus attains an impact sound which is produced at a time when a putter face having a rigidity higher than the ball 7 (for example, a putter face made of metal) collides with the ball 7. Therefore, it is possible to attain a sense based on sound (hereinafter referred as "sense of sound") that compares favorably with the metal face. Thus, it is possible to attain a sufficient initial velocity, sense of sound and striking touch, each of which is not attainable from a resin face.

Moreover, effects thus operating synergistically enables attainment of (i) an initial velocity, an intermediate velocity, and an attained distance of the ball 7, that are compared favorably to that of the hard metal putter face, with respect to a motion velocity (impact energy) of the putter head 1, and (ii) sufficient linearity (proportionality) with respect to the putter head 1 having these physical quantities.

The following is a description of a relationship of a rigidity of the impact absorbing rings 5 and a coefficient of restitution of the face surface (the plurality of hexagonal posts 4 having the contact surfaces 41), with respect to (a) and (c) in FIG. 13. In FIG. 13, (a) illustrates a case where material having a relatively high rigidity is used as the material of the impact absorbing rings 5, and (c) illustrates a case where material having a relatively low rigidity is used as the material of the impact absorbing rings 5. As illustrated in (a) and (c) of FIG. 13, the higher the rigidity of the impact absorbing rings 5, the smaller the degree in elastic deformation. As a result, the coefficient of restitution is thought to be close to the coefficient of restitution of a putter face made of metal.

On the other hand, as illustrated in (a) and (c) in FIG. 13, the lower the rigidity of the impact absorbing rings 5, the larger the degree of elastic deformation. As a result, the coefficient of restitution is thought be close to the coefficient of restitution of a putter face made of resin (see (b) in FIG. 13).

Similarly, adjustment of the rigidity of the impact absorbing rings 5 allows adjustment of the degree of elastic deformation when the ball 7 collides with the face surface.

Therefore, appropriate adjustment of the impact absorbing rings 5 enables to provide a putter face and a golf putter which has (i) a coefficient of restitution compared favorably with a putter face made of metal, and (ii) a ball control property compared favorably with a resin putter face. In other words, it is possible to provide a putter face and a golf putter which has both features of the putter face made of metal and the resin putter face.

The following shows a result of an experiment in which a contact time of a ball at a time of impact was compared between the putter face 2 (putter faces 2A and 2B) of the present embodiment and a putter face made of metal (hereinafter referred to as "comparative example"; note that a putter face made of aluminum, which belongs to a group of metals that are soft, is used as the comparative example).

In the experiment, a ball was struck by a linear uniform motion of the putter face 2 or the putter face as the comparative example at a speed of 700 mm/sec. As a surface on which the ball is to roll on, a surface that rolls with ease to the same degree as so-called fast green having a stimpmeter measurement of 11 feet was used. The fast green causes the ball to roll with ease, among other greens in various golf courses.

Figure 14:
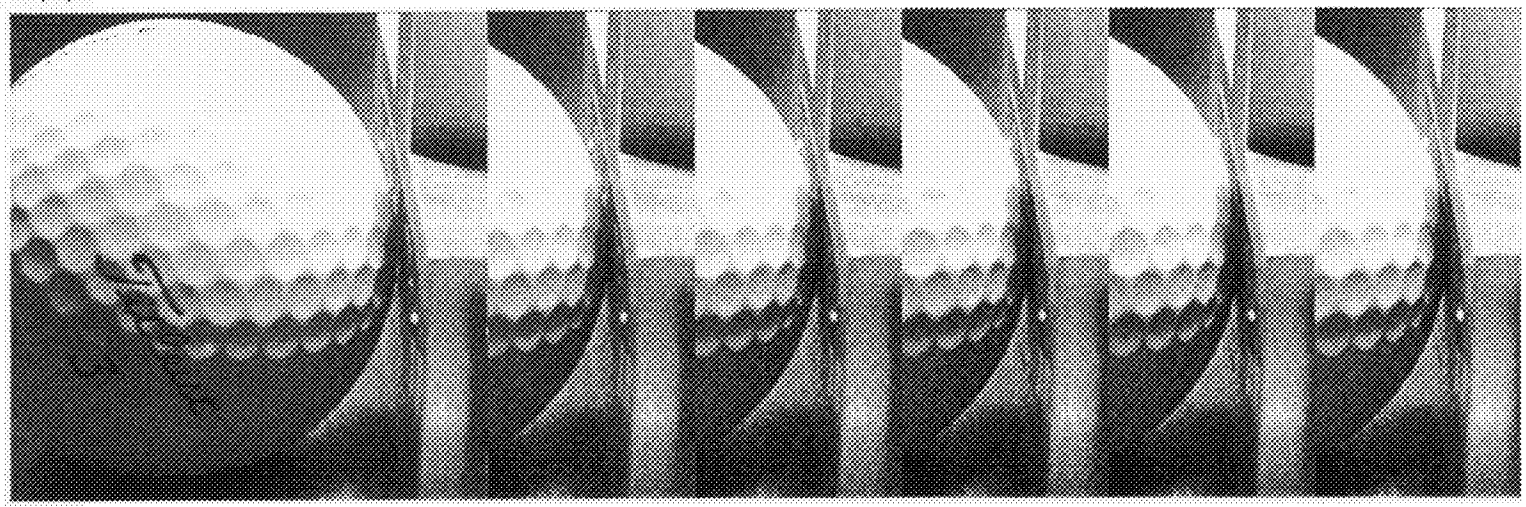
FIG. 14 is a diagram illustrating a photographic result by use of a high-speed camera, for verifying a contact time of a ball and the putter face at a time of impact, and a contact time of a ball as a comparative example, wherein (a) illustrates a photographic result by use of a high speed camera for verifying a contact time of a ball and the putter face, and (b) illustrates a photographic result by use of a high speed camera for verifying a contact time of a ball as the comparative example.
Figure 14:
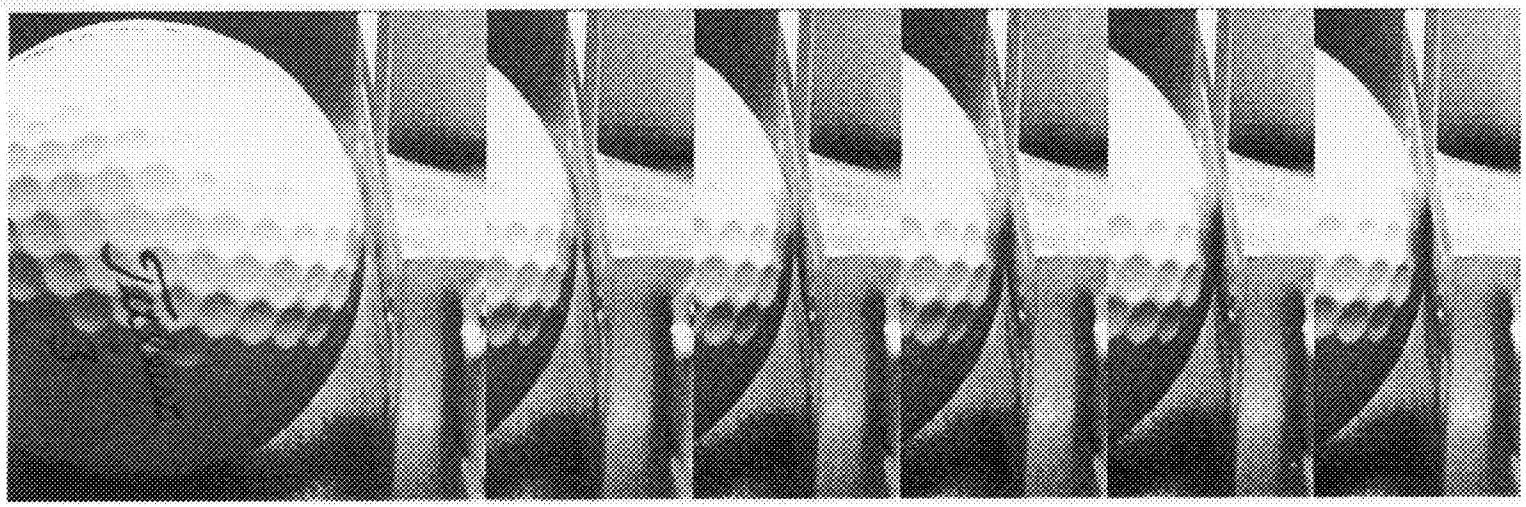
Figure 15:
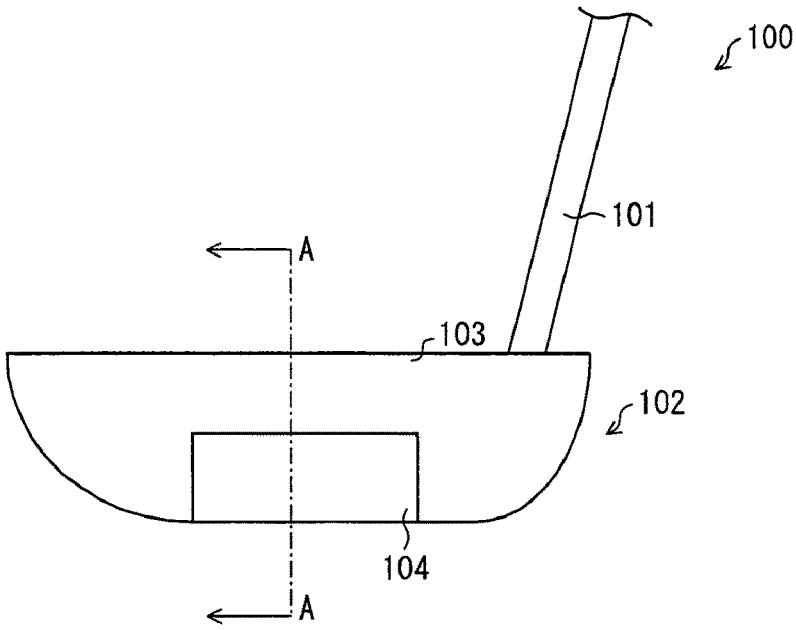
FIG. 15 is a diagram schematically illustrating a golf putter in which a resin putter face is inserted to a head of the golf putter, wherein (a) illustrates a front view from a face surface side, of the golf putter having a head which has the resin putter face inserted therein, and (b) illustrates a side view of the golf putter.
Figure 15:
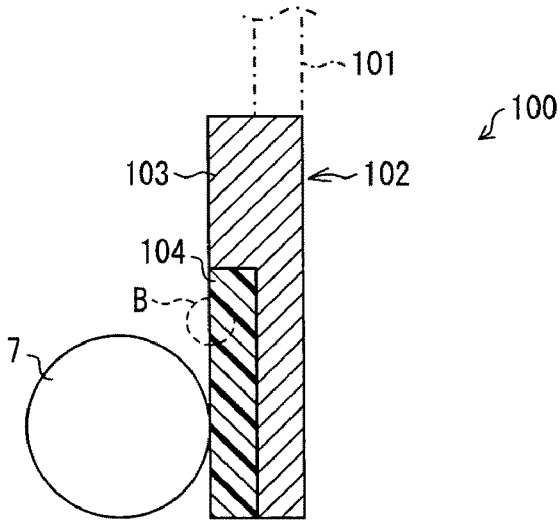

In FIG. 14, (a) shows a photographic result by use of a high speed camera which verifies a contact time of the ball with the putter face 2 at the time of impact, and (b) shows a photographic result by use of a high speed camera which verifies a contact time of the ball with the putter face of the comparative example.

The photographic result of (a) and (b) in FIG. 14 is one that is photographed by use of a high speed camera which photographs 6000 frames in one second. However, the (a) and (b) in FIG. 14 has alternately skipped one frame. Therefore, the photographic result is one that calculates 3000 frames in one second.

As illustrated in (b) of FIG. 14, a face surface of the comparative example and the ball are clearly separate from each other in the third frame from the top, however a face surface of the putter face 2A and the ball are clearly still in a contact state.

Moreover, the face surface of the putter face 2 and the ball is shown as clearly separated in the sixth frame from the top, as in (a) of FIG. 14.

Therefore, according to motion analysis of the ball by use of the high speed camera, the ball contact time of the face surface of the putter face of the comparative example made of aluminum, which has a low rigidity among the metals, was approximately 0.001 seconds (=3/3000), whereas the ball contact time of the face surface of the putter face 2 was approximately 0.002 seconds (=6/3000), which is approximately twice the time of that of the comparative example. This result verifies that the ball contact time of the face surface at the time of impact with the putter face 2 is significantly longer than a metal putter face.

In addition, a total distance of which the ball rolled was 1200 mm and 1150 mm, of the comparative example and the putter face 2, respectively. This remained to just a reduction of 5%.

This result verifies that the putter face 2 strikes a distance compared favorably to the putter face of the comparative example, and that the energy loss in the putter face 2 is relatively small, regardless that the contact time is approximately twice as long.

As described above, it was verified that the putter face 2 (putter faces 2A and 2B) and the golf putter that has the putter face 2 solves the problem of occurrence of a shift of a rebounding direction caused by a contact of the golf ball and a ball contact surface of the putter face, and that an initial velocity, a striking touch, and a sense of distance of the ball, each of which compares favorably to a metal putter face is attained.

The present invention is not limited to the description of the embodiments above, but may be altered by a skilled person within the scope of the claims. An embodiment pedestald on a proper combination of technical means disclosed in different embodiments is encompassed in the technical scope of the present invention.

A putter face of the present invention is a putter face to be inserted to a golf head putter, the putter face including: a plurality of pillar-shaped bodies, each made of material having a higher rigidity than a ball, and each having a contact surface that has contact with the ball; and a plurality of elastic bodies, each being attached to respective one of the pillar-shaped bodies so as to elastically support the respective one of the pillar-shaped bodies in a normal direction of the contact surfaces, and each made of material having a lower rigidity than that of the respective one of the pillar-shaped bodies, the plurality of pillar-shaped bodies being juxtaposed in an in-plane direction of the contact surfaces, and the contact surfaces of the plurality of pillar-shaped bodies constituting a single surface when a ball is not in contact with the contact surfaces.

In addition, the putter face of the present invention is a putter face to be inserted detachably with respect to a golf putter head, the putter face including: a plurality of pillar-shaped bodies, each made of material having a higher rigidity than a ball, and each having a contact surface that has contact with the ball; and an elastic body being attached to respective one of the pillar-shaped bodies so as to elastically support the respective one of the pillar-shaped bodies in a normal direction of the contact surface, and made of material having a lower rigidity than that of the respective one of the pillar-shaped bodies, the plurality of pillar-shaped bodies being juxtaposed in an in-plane direction, and that contact surfaces of the plurality of pillar-shaped bodies constituting a single surface when a ball is not in contact with the contact surfaces.

According to the arrangement, the putter face of the present invention includes: a pillar-shaped body made of material having a higher rigidity than a ball, and has a contact surface on which the ball has contact; and an elastic body made of material having a lower rigidity than that of the pillar-shaped body, so as to elastically support the pillar-shaped body in a normal direction of the contact surface.

The arrangement is one which a contact surface that has direct contact with a ball has high rigidity (is unreadily deformed), and impact of a collision on the contact surface is indirectly absorbed by an elastic deformation of an elastic body. Therefore, loss in coefficient of restitution is minimized as compared to a soft resin face (readily deformed). Namely, since the loss in coefficient of restitution is small as compared to a face made of soft material such as resin, it is possible to attain, at a time of the impact, an initial velocity that compares favorably with a metal face.

Moreover, kinetic energy of the ball is proportional to a square of the initial velocity. Therefore, loss in energy at the time of the impact is also reduced. As a result, it is possible to attain a touch of striking (hereinafter referred to as simply "striking touch") and a sense of distance (rolling in accordance with the touch), each of which are compared favorably with the metal face.

At the time of the impact, the contact surface of the pillar-shaped bodies made of the material having the higher rigidity than the ball collides with the ball. This thus attains an impact sound which is produced at a time when a putter face having a rigidity higher than the ball (for example, a putter face made of metal) collides with the ball. Therefore, it is possible to attain a sense based on sound (hereinafter referred to as "sense of sound") that compares favorably with the metal face. Thus, it is possible to attain a sufficient initial velocity, sense of sound and striking touch, each of which is not attainable from a resin face.

According to the arrangement, the putter face of the present invention is arranged such that the putter face includes a plurality of the elastic bodies, each being attached to respective one of the pillar-shaped bodies. This thus enhances independency of elastic motion of each of the pillar-shaped bodies.

According to the arrangement, it is possible to arrange the putter face of the present invention such that when the ball has contact with the respective contact surface of the plurality of pillar-shaped bodies, the plurality of elastic bodies are elastically deformed in the normal direction so that the respective contact surfaces have contact with a plurality of places on a surface of a ball (the face surface deforms so that the contact surfaces are alongside the surface of the ball).

Until there is contact with the ball, the plurality of pillar-shaped bodies are juxtaposed in an in-plane direction of the contact surfaces so that the contact surfaces of the pillar-shaped bodies constitute a single surface when the ball is not in contact with the contact surfaces.

That is to say, assume a case where a ball collides on a face surface in a perpendicular direction with respect to the face surface, in an initial condition that the contact surfaces of the pillar-shaped bodies constitute a single surface when a ball is not in contact with the contact surfaces. Note that, from motion relativity, this alternatively can be considered as having the ball collide on the face surface of a still golf putter instead of striking a still ball by use of the golf putter. In such a case, it is expected that the contact surfaces isotropically deform about its center which is a contact point of the ball and the face surface (assumedly substantially matching an intersection of a central axis of the ball in a normal direction of the face surface and the face surface), due to spherical symmetry of the ball. Note that this isotropic deformation of the contact surface would still be attained even if deformation of the ball occurs.

In view of this, it is expected that all of repulsion vectors (reaction vector) which have effect on a contact section on the contact surfaces of the ball are accurately directed to a vicinity of a predetermined point on a central axis of the ball in the normal direction of the face surface. In addition, a resultant vector of these is accurately directed to a direction along the central axis, that is, the normal direction of the face surface. The ball receives force in a direction along the resultant vector, therefore the ball accurately rolls in the direction along the resultant vector, that is, the normal direction of the face surface.

Strictly speaking, in a collision phenomenon, it is necessary to solve an equation of motion in which a difference in momentum vector before and after colliding to a ball is equal to an integral of an impulse vector of which the ball has received, and complex simultaneous equations such as a relational expression between a coefficient of restitution of the face surface and a change in velocity before and after colliding to the ball. However, qualitatively, the direction of the resultant vector is considered such that during the collision, the direction of the resultant vector is hardly shifted from the direction along the central axis. Therefore, it is expected that the above conclusion be attained.

Therefore, as described above, the contact surfaces of the plurality of pillar-shaped bodies have contact with the ball in a plurality of places on the surface of the ball so that the contact surfaces are alongside the surface of the ball. Therefore, occurrence of shift of a rebounding direction of the ball caused by the point contact with the dimple edge part on the surface of the ball is prevented.

A phenomenon called face rotation is often raised as a problem. This face rotation is a phenomenon such that, even if a ball is impacted provided that a moving direction of the putter head visually matches with the normal direction of the face surface of the putter race (or the contact surfaces of the plurality of pillar-shaped bodies), a progressing direction of the ball is shifted off from the moving direction of the putter head (aimed direction) due to the arrangement of the golf putter.

This phenomenon is caused by having two elliptic trajectories: (1) a striking trajectory of the putter head (an elliptic trajectory in a substantially perpendicular direction with respect to the putter head); and (2) a rotational trajectory of the putter head in line with a user's body (an elliptic trajectory in a substantially horizontal direction with respect to a face surface seen from above), be combined into one complex trajectory, as a trajectory of the face surface of the golf putter. As a result, the face surface has contact with the ball in a direction that is shifted off from a direction perpendicular to the face surface (aimed direction) at the time of the impact, even though the normal direction of the face surface and the moving direction of the putter head visually match with each other.

Moreover, at the time of the impact on the ball, a motion to return the face is often carried out by naturally synchronizing with a wrist movement. However, in such a case, the face surface rotates about an axis which runs substantially along a shaft of the golf putter. When this rotating movement is further added to the two elliptic movements, the face rotation becomes more intense.

In comparison, in the putter face of the present invention, the face (the contact surfaces of the plurality of pillar-shaped bodies) deforms at the moment of impact so as to have a longer contact time between the ball and the face as compared to the golf putter having a metal face, even if the face surface has contact with the ball in an angle shifting off a perpendicular direction with respect to the ball caused by the face rotation movement.

The reaction received from the face surface of the golf putter during the contact time is further divided into (i) normal force in a perpendicular direction of the face surface and (ii) friction in the in-plane direction of the face surface. In theory, this friction has a component which causes the ball to correct its progressing direction so as to follow a moving direction (aimed direction) of the putter head (impede the ball from shifting off sideways with respect to the face surface) as a result of elastic deformation of the face surface.

Here, the putter head made of metal is regarded as a rigid body whose face surface does not deform. Therefore, the contact time of the ball and the face is short, and is considered that hardly any friction occurs with the putter head made of metal.

On the other hand, in the putter face of the present invention, each of the plurality of pillar-shaped bodies is elastically deformable. Therefore, at the time of the impact, the face surface deforms so as to be alongside the surface of the ball, thereby having contact with a plurality of places on the ball. Therefore, as described above, along with a long contact time between the ball and the face, it is expected that sufficient friction occurs on the ball as compared to the putter head made of metal.

Accordingly, caused by this friction, the progressing direction of the ball is corrected so as to be closer to the aimed direction than that of a hard metal putter face. Therefore, it is possible to accurately strike the ball in the moving direction (aimed direction) while compensating a slight angle shift of the face.

In other words, it is assumed that since a component of friction that corrects a shift in a striking direction of the ball from the moving direction of the putter head (aimed direction) is sufficiently provided with respect to an impulse given to the ball, it is possible to prevent the occurrence of shift of the striking direction of the ball 7 from the aimed direction.

It is believed that intermediate and advanced golf players are able to use different types of shots for different purposes. Particularly in putting, it is considered that subtle ball control is required. For example, there are many examples in which strengths and weaknesses (for example, a hook ball in which a ball hit by a right (left) player swerves to the left (right), and a slice ball which is the opposite of that) influences a result of a game.

As described above, the putter face of the present invention is arranged such that when the ball has contact with the respective contact surfaces of the plurality of pillar-shaped bodies, the plurality of elastic bodies are elastically deformed in the normal direction of the face surface (contact surface) so that the respective contact surfaces have contact with a plurality of places on a surface of a ball.

Therefore, in the putter face of the present invention, the face (the contact surfaces of the plurality of pillar-shaped bodies) deforms at the moment of impact so as to have a longer contact time between the ball and the face as compared to the golf putter having the metal face.

Moreover, as described above, the reaction received by the ball from the face surface of the golf putter during the contact time is divided into (i) the normal force in a perpendicular direction of the face surface and (ii) the friction in the in-plane direction of the face surface. This friction is considered to be fairly great as compared to the golf putter having the hard metal face which is difficult to elastically deform (as a result, having a short contact time between the ball and the face).

Accordingly, the golf putter of the present invention is sufficiently effected by the friction as compared to the golf putter having the metal face. This thus allows, as compared to the golf putter having the metal face, improvement of the ball control performance such as using various types of shots for different purposes such as the hook ball, and the slice ball opposite of the hook ball, improvement of propulsion to the aim by applying topspin (also referred as "positive rotation"; hereinafter referred as similar) to the ball, and further applying backspin (negative rotation) to the ball so that the ball stops on the green.

Moreover, the effects thus operating synergistically enables attainment of (i) an initial velocity, an intermediate velocity, and an attained distance of the ball, each of which are compared favorably to that of a hard metal putter face, with respect to a motion velocity (impact energy) of the putter head, and (ii) sufficient linearity (proportionality) with respect to the putter head having these physical quantities.

As the above, it is possible to provide a putter face that can attain an initial velocity, a striking touch, and a sense of distance of a ball, each of which compares favorably with a metal face, while solving a problem of an occurrence of a shift of a rebounding direction caused by a golf ball and a ball contact surface of the putter face having contact with each other.

The putter face of the present invention, in addition to the above arrangement, may be arranged such that the plurality of pillar-shaped bodies are juxtaposed in the in-plane direction of the contact surfaces with no space between respective adjacent ones of the plurality of pillar-shaped bodies.

Technically speaking, it is possible to interpret "juxtaposed with no space between respective adjacent ones" as including a case where the plurality of pillar-shaped bodies are juxtaposed so closely such that the pillar-shaped bodies cannot move independently (the plurality of pillar-shaped bodies giving strong pressure against each other in the in-plane direction of the contact surface). However, the golf putter or the putter face of the present invention is supposed that the pressure given by the plurality of pillar-shaped bodies in the in-plane direction of the contact surfaces is small to a degree that the plurality of pillar-shaped bodies are independently movable. Alternatively, it is also interpretable that the plurality of the pillar-shaped bodies are "juxtaposed with no space between respective adjacent ones" to a degree such that rotation of each of the plurality of pillar-shaped bodies in the in-plane direction of the contact surfaces is prevented. Namely, it is preferable for the plurality of the pillar-shaped bodies to be "juxtaposed with no space between respective adjacent ones" from a view of improving area efficiency of the face surface while keeping independency in movement of the plurality of pillar-shaped bodies, and from a view of preventing rotation in the in-plane direction.

In such a case, the putter face of the present invention, in addition to the above arrangement, may be arranged such that each of the contact surfaces may have a shape of a regular triangle, a parallelogram, or a regular hexagon.

According to the arrangement, it is possible to juxtapose identically-shaped contact surfaces with no space between respective adjacent ones, so as to constitute a single surface (face surface). That is to say, a number of contact surfaces per area is maximized for each shape. Therefore, it is possible to maximize the effect of the present invention with respect to the shape of the contact surface. In order to particularly maximize the effect of the present invention, it is preferable to arrange the face surface in a honeycomb structure, that is, to have the shape of the contact surfaces as the regular hexagonal shape. This is because, in order to enhance symmetric property of a regular n polygon (n is a natural number), it is necessary to have a large number of n; the largest number possible of n for a regular n polygon which can juxtapose identically-shaped contact surfaces with no space between respective adjacent ones on a single plane is 6 (i.e., n=6).

A circle has a highest symmetric property, and it is also possible to adopt a circle as the shape of the contact surface. In such a case, although it is not possible to juxtapose the contact surfaces with no space between the respective adjacent ones so as to constitute the single plane, it is possible to maximize motion performance of each pillar-shaped body and dynamic balance with respect to the whole face.

Moreover, the parallelogram, from its property that a sum of the opposing interior angle adds up to 180°, is considered that it is possible to juxtapose identical parallelogram-shaped contact surfaces on the plane surface. Needless to say, a rhombus, a rectangle, a square and the like are included in the parallelogram.

Further, in a case where it is possible to juxtapose the contact surfaces with no space between the respective adjacent ones so as to constitute the plane surface, there is just one arrangement pattern for the plurality of pillar-shaped bodies. However, if there is a space between the respective adjacent contact surfaces, a plurality of arrangement patterns can be considered. Therefore, troublesome work in order to find a best pattern in the plurality of arrangement patterns occurs.

As such, in the case where the place surface cannot be juxtaposed with the contact surfaces with no space between the respective adjacent ones, work efficiency of creation of the putter face is likely to significantly decrease. Therefore, if the shape of the contact surfaces is one of the regular triangle, the parallelogram, or the regular hexagon, it is possible to maximize the work efficiency of the putter face creation. Moreover, if the plane surface is juxtaposed with the contact surfaces, there is no possibility of waste coming into the face thereby causing a need to take away the waste.

The putter face of the present invention, in addition to the above arrangement, may be arranged such that the plurality of pillar-shaped bodies are, slidably in the normal direction of the contact surfaces, inserted and fitted in a plurality of holes, respectively, the plurality of holes being provided in a pedestal that is provided on a side opposed to the contact surfaces so as to engage the plurality of pillar-shaped bodies with the pedestal, and the plurality of pillar-shaped bodies include engaging sections, respectively, via which the plurality of pillar-shaped bodies engage with the pedestals.

Moreover, the putter face of the present invention, in addition to the above arrangement, may be arranged such that a pedestal is provided to a side opposed to the contact surfaces, the pedestal having a plurality of holes in which the plurality of pillar-shaped bodies are inserted and fitted, respectively, slidably in the normal direction of the contact surfaces, so as to engage the plurality of pillar-shaped bodies with the pedestal.

According to the arrangement, the plurality of pillar-shaped bodies can be, slidably in the normal direction of the contact surfaces, inserted and fitted in a plurality of holes, respectively, the plurality of holes being provided in a pedestal that is provided on a side opposed to the contact surfaces. Therefore, it is possible to derive a shifting direction of the pillar-shaped bodies to a normal direction of the contact surface, while preventing the pillar-shaped bodies from sliding out of the putter face.

The putter face of the present invention, in addition to the above arrangement, may be arranged such that one elastic body is provided, and the plurality of pillar-shaped bodies are attached to the one elastic body.

According to the arrangement, it is assumed that independency of the elastic motion of each of the pillar-shaped bodies would somewhat decrease as compared to a case where a plurality of elastic bodies are attached to a plurality of pillar-shaped bodies, respectively. However, the number of the elastic body is just one, thereby can be easily produced.

The putter face of the present invention, in addition to the above arrangement, may be arranged such that the elastic body has a plurality of holes in which the plurality of pillar-shaped bodies are inserted and fitted, slidably in the normal direction of the contact surfaces, so as to engage the plurality of pillar-shaped bodies with the elastic body.

According to the arrangement, the pillar-shaped bodies can be inserted and fitted, slidably in the normal direction of the contact surfaces, in a plurality of holes that are provided in the elastic body. Therefore, it is possible to derive a shifting direction of the pillar-shaped bodies to the normal direction of the contact surfaces, while preventing the pillar-shaped bodies from sliding out of the putter face.

The putter face of the present invention, in addition to the above arrangement, may be arranged such that a space is formed between respective adjacent contact surfaces.

According to the arrangement, the independency of the elastic motion of each of the plurality of pillar-shaped bodies is enhanced by providing a space between respective adjacent contact surfaces of the plurality of pillar-shaped bodies so as to appropriately adjust spacing between respective adjacent pillar-shaped bodies.

The putter face of the present invention, in addition to the above arrangement, may be arranged such that each of the contact surfaces has a closed shape.

In a case where the arrangement having the space between respective adjacent contact surfaces is adopted as the putter face, each of the contact surfaces of the plurality of pillar-shaped bodies may be shaped in any shape as long as the shape is a closed shape.

However, as described above, in a case the circle is adopted, it is possible to maximize motion performance of the pillar-shaped bodies and dynamic balance with respect to a whole face. In addition, even if the pillar-shaped bodies rotate in an in-plane direction of the contact surface, an outer appearance is not disfigured, since the contact surface is circular.

Note that in a case a polygon is to be adopted, adoption of a regular hexagon (so-called honeycomb structure) enables to maximize an area of which the pillar-shaped bodies occupy the putter as a whole, as compared to adopting other polygons or a circle.

As the above, it is possible to provide a putter face that can attain an initial velocity, a striking touch, and a sense of distance of a ball, each of which compares favorably with a metal face, while solving a problem of an occurrence of a shift of a rebounding direction caused by a golf ball and a ball contact surface of the putter face having contact with each other.

A golf putter of the present invention which includes a head may have any one of the putter faces inserted to the head.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A putter face to be inserted into a golf putter head, the putter face comprising:

a plurality of pillar-shaped bodies, each said pillar-shaped body being made of a material having higher rigidity than a ball to be struck by said putter face, and each said pillar-shaped body having a contact surface for making contact with said ball, a plurality of elastic bodies, each said elastic body being attached to a respective one of the pillar-shaped bodies so as to elastically support said respective one of the pillar-shaped bodies in a normal direction of its contact surface, and each said elastic body being made of a material having lower rigidity than that of the one of said pillar-shaped bodies to which it is attached; and the plurality of pillar-shaped bodies being juxtaposed in an in-plane direction such that the contact surfaces of the plurality of pillar-shaped bodies constitute a single surface when a ball is not in contact with the contact surfaces; wherein:

the plurality of pillar-shaped bodies are, slidably in the normal direction of the contact surfaces, inserted and fitted in a plurality of holes, respectively, the plurality of holes being provided in a pedestal that is provided on a side opposed to the contact surfaces so as to engage the plurality of pillar-shaped bodies with the pedestal, and the plurality of pillar-shaped bodies include engaging sections, respectively, via which the plurality of pillar-shaped bodies engage with the pedestal.

2. A putter face to be inserted into a golf putter head, the putter face comprising:

a plurality of pillar-shaped bodies, each said pillar-shaped body being made of a material having higher rigidity than a ball to be struck by said putter face, and each said pillar-shaped body having a contact surface for making contact with said ball, a plurality of elastic bodies, each said elastic body being attached to a respective one of the pillar-shaped bodies so as to elastically support said respective one of the pillar-shaped bodies in a normal direction of its contact surface, and each said elastic body being made of a material having lower rigidity than that of the one of the pillar-shaped bodies to which it is attached; and the plurality of pillar-shaped bodies being juxtaposed in an in-plane direction such that the contact surfaces of the plurality of pillar-shaped bodies constitute a single surface when a ball is not in contact with the contact surfaces, wherein:

a pedestal is provided on a side opposed to the contact surfaces, the pedestal having a plurality of holes in which the plurality of pillar-shaped bodies are inserted and fitted, respectively, slidably in the normal direction of the contact surfaces thereof, so as to engage the plurality of pillar-shaped bodies with the pedestal.

* * * * *